US006416674B1

(12) United States Patent
Singleton et al.

(10) Patent No.: US 6,416,674 B1
(45) Date of Patent: Jul. 9, 2002

(54) SILT-GUARD APPARATUS FOR USE IN A DETENTION POND

(76) Inventors: Earl Roger Singleton, 1060 Ellington Rd., Oxford, GA (US) 30054; Raymond Joseph Dobbs, 220 Eastfield Dr., McDonough, GA (US) 30252

( * ) Notice: Subject to any disclaimer, the term of this patent is extended or adjusted under 35 U.S.C. 154(b) by 46 days.

(21) Appl. No.: 09/639,463

(22) Filed: Aug. 15, 2000

Related U.S. Application Data

(63) Continuation-in-part of application No. 09/465,501, filed on Dec. 17, 1999, now Pat. No. 6,261,445, which is a continuation-in-part of application No. 09/052,649, filed on Mar. 31, 1998, now Pat. No. 6,004,457, which is a continuation-in-part of application No. 09/834,446, filed on Apr. 16, 1997, now Pat. No. 5,843,306.

(51) Int. Cl.[7] ..... C02F 7/00

(52) U.S. Cl. ..... 210/747; 210/767; 210/163; 210/166; 210/170; 210/232; 210/460; 210/462

(58) Field of Search ..... 210/747, 767, 210/163, 166, 170, 232, 460, 462

(56) References Cited

U.S. PATENT DOCUMENTS

| | | | | | |
|---|---|---|---|---|---|
| 770,019 | A | | 9/1904 | Neireiter | |
| 1,310,055 | A | | 7/1919 | Caldwell | |
| 1,791,512 | A | | 2/1931 | Schurman | |
| 3,517,813 | A | | 6/1970 | Thaler | 210/166 |
| 3,713,539 | A | | 1/1973 | Thompson et al. | 210/164 |
| 4,268,390 | A | | 5/1981 | Cunningham | 210/232 |
| 4,419,232 | A | | 12/1983 | Arntyr et al. | 210/164 |
| 4,460,462 | A | | 7/1984 | Arneson | 210/163 |
| 4,525,273 | A | | 6/1985 | Logsdon | 210/164 |
| 4,658,449 | A | | 4/1987 | Martin | 4/496 |
| 4,719,724 | A | * | 1/1988 | Ditcher | |
| 4,925,342 | A | | 5/1990 | Hendy | 405/45 |
| 4,957,389 | A | * | 9/1990 | Neathery | |
| 5,062,735 | A | * | 11/1991 | Gaudin | |
| 5,284,580 | A | | 2/1994 | Shyh | 210/163 |
| 5,297,367 | A | | 3/1994 | Sainz | 52/12 |
| 5,297,895 | A | | 3/1994 | Johnson | 405/41 |
| 5,469,670 | A | | 11/1995 | Thaler | 52/12 |

(List continued on next page.)

OTHER PUBLICATIONS

HydroCAD® Stormwater Modeling System, Sample Pond #1, pp. 1–4, 1997, www.hydrocad.net/pond1.htm.

HydroCAD® Stormwater Modeling System, Sample Pond #2, pp. 1–2, 1997. www.hydrocad.net/pond2.htm.

*Manual for Erosion and Sediment Control in Georgia*, Fifth Edition 2000, Georgia Soil and Water Conservation Commission.

*Field Manual for Erosion and Sediment Control in Georgia*, Third Edition 1997, Georgia Soil and Water Conservation Commission.

Catch Basin Erosion Barrier® As Manufactured by Royal Anchor Systems, Inc., Infra–Safe™, which may have been made publicly available as early as Jan. 1998.

*Primary Examiner*—Betsey Morrison Hoey
(74) *Attorney, Agent, or Firm*—Womble Carlyle Sandridge & Rice, LLP

(57) ABSTRACT

A silt guard apparatus for filtering runoff water, including a fluid distributing pan coupled to a silt guard or filtering device. The silt guard apparatus is fitted over and seated upon a drainage pipe for controlling erosion at construction sites and for trapping and preventing oily residues and/or solid particles such as silt and other debris from being washed into, collected or being otherwise deposited within a water drainage pipe with the runoff water, while still enabling water to drain therethrough. The fluid distributing pan of the present invention includes an orifice, and may further include a fluid receiving body surrounding the orifice and a connecting member contiguous with the fluid receiving body. The connecting member functions to couple the silt guard to the fluid distributing pan to form the silt-guard apparatus, which in another embodiment is interconnected and substantially sealed to the drainage pipe.

27 Claims, 11 Drawing Sheets

U.S. PATENT DOCUMENTS

| | | | | |
|---|---|---|---|---|
| 5,486,287 | A | | 1/1996 | Murphy et al. ..... 210/164 |
| 5,526,613 | A | | 6/1996 | Simeone, Jr. ..... 52/12 |
| 5,575,925 | A | | 11/1996 | Logue, Jr. ..... 210/747 |
| 5,587,072 | A | | 12/1996 | Regan ..... 210/232 |
| 5,643,445 | A | | 7/1997 | Billias et al. ..... 210/162 |
| 5,650,065 | A | | 7/1997 | Sewell ..... 210/166 |
| 5,733,444 | A | * | 3/1998 | Johnson |
| 5,744,048 | A | | 4/1998 | Stetler ..... 210/803 |
| 5,843,306 | A | | 12/1998 | Singleton ..... 210/163 |
| 5,966,876 | A | * | 10/1999 | Neathery et al. |
| 6,004,457 | A | | 12/1999 | Singleton ..... 210/163 |

* cited by examiner

SILT-GUARD APPARATUS FOR USE IN A DETENTION POND

CROSS REFERENCE TO RELATED APPLICATIONS

The present application is a continuation-in-part of U.S. patent application Ser. No. 09/465,501, filed Dec. 17, 1999, now U.S. Pat. No. 6,261,445 issued Jul. 17, 2000, which is a continuation-in-part of U.S. patent application Ser. No. 09/052,649, filed Mar. 31, 1998, now U.S. Pat. No. 6,004, 457 issued Dec. 21, 1999, which is a continuation-in-part of U.S. patent application Ser. No. 09/834,446, filed Apr. 16, 1997 and issued as U.S. Pat. No. 5, 843,306 on Dec. 1, 1998.

FIELD OF THE INVENTION

The present invention relates in general to devices for controlling erosion at construction sites, and in particular to an apparatus that fits over and encloses and is removably mountable to the open end of an underground drainage pipe so as to trap and prevent solid particles and oily residues from being washed into or being otherwise deposited within the pipe, while still enabling water to drain therethrough.

BACKGROUND OF THE INVENTION

In the construction of new housing and other types of developments, it is often necessary, if not in fact required by local or state law, to provide drainage and/or detention ponds to deal with construction site debris, erosion of soil, and storm water drainage. In general, clearing, grading and leveling of the land results in erosion of the remaining bare soil. It is not permissible for the construction site manager to allow the construction site debris, silt, sand, rocks, and the like, to adversely impact the surrounding properties, by for instance, polluting the rivers and streams by silt carried from the land with rainwater or by clogging of the sewer lines.

Typically, the road system is first marked out and the streets into and through the development are cut and graded. Thereafter, the storm water drainage system for the development is constructed, which typically includes the underground drainage pipes, collection boxes and culverts, and drop inlets that form the manholes or drain openings along the street. Additionally, a detention pond, (otherwise known as retention or silt collection ponds), may be created, usually at the lowest elevation of the construction site, to collect the storm water runoff and the silt carried with it. An elongated cylindrical standpipe is commonly placed in a vertical orientation within the low point of the pond and a steel and gravel trash rack (see, for instance, FIG. 1A) or a V-shaped weir (see, for instance, FIG. 1B) is formed around the top of the pipe. A drainage pipe in communication with the standpipe at its bottom portion extends outside the pond. In use, rainwater flows from higher elevations of the land and fills the pond until the water level in the pond rises to the bottom of the V-shaped weirs. Excess water then drains through the weirs into the standpipe and out of the pond through the drainage pipe. The V-shaped weir and the trash rack are typically designed to create residence time in the pond to allow the silt to settle out of the water before the water enters the drainage system, rather than actively filter the solid particles from the water. Additionally, during periods of heavy water flow, there is no means to control the rate of flow through the drainage pipes, which may result in flooding of the drainage system.

Another problem associated with construction sites is the dispersion of oily residues on the soil. Such oily residues typically come from trucks, paving machines, heavy machinery and the like, by spills and/or leaks. During a rainstorm, the water will tend to entrap the oily residue, washing it away with the silt, which ends up polluting the storm water drainage system of the site.

Typically, in the construction of a storm water drainage system, culverts are installed after the street bed has been graded, whereupon drop inlets are then installed and connected to the culverts and to the collection boxes. The drop inlets generally are substantially cylindrical concrete pipes that are installed vertically, with their lower ends connecting to the collection boxes and drainage pipes, and their upper ends being substantially at street level. Once the grading of the street bed has been completed and the drainage system substantially installed, the drainage system then will be buried and the curbs for the street are graded and poured. Thereafter, throats are provided for the manholes, the throats being poured about the open ends of the drop inlets to form the curb inlets or drains and manholes along the sides of the streets through which storm water drains.

During the construction of roads and drainage systems, until the street has been substantially completed and the curbs and throats of the sewer system have been poured, the drainage pipes and inlets must be kept substantially free of dirt and debris pursuant to state and county building codes. Keeping dirt and debris out of the drainage system is, however, very difficult to accomplish. For instance, during grading of the curbs as well as additional grading on site, dirt and debris is pushed around the site by the motor grader or bulldozer, and thus may pass into the open upper ends of the drop inlets and/or detention pond drainage pipes. In addition, rain, runoff and wind also tend to wash or blow dirt and debris into the detention pond drainage pipes and open ends of the drop inlets, which then collects in the collection boxes and sewer drainage system.

If dirt and debris are washed into or otherwise collected within the collection boxes and/or other parts of the drainage system, it becomes necessary to unclog the system to comply with building code regulations. One such method of cleaning the system is to send laborers down into the drop inlets and collection boxes to manually clean out the dirt and/or debris that has been washed or accidentally dropped into the drainage pipes. Such cleaning operations are difficult as the pipes are somewhat cramped, making it difficult to maneuver, and there is also the danger of cave-ins or collapse of the dirt, etc. that has built up around the sides of the drop inlets, creating a significant risk of injury or even death to the laborers below. In addition, there can be as much as a ten to twelve-foot drop from the surface of the road, and the upper end of the drop inlet, to the bottom of the collection box on which the drop inlet is mounted. A fall from such a height can cause severe injuries to persons who might inadvertently fall into the inlet, especially as the open end of the inlet becomes obscured by dirt and other debris. The danger of an exposed, i.e. open, ten to twelve-foot drop inlet is especially great for children who might play around the area and are more likely to be curious and to inadvertently fall in and become trapped within the drainage pipes.

In the past, the open upper ends of the drop inlets generally have been protected with a simple silt fence constructed of a flexible mesh or screen material attached to a series of wooden stakes positioned about the open upper end of the drop inlet. Such an arrangement is illustrated in FIG. 2A, which shows in general the known method of enclosing and marking the open end of a drop inlet at construction sites. Such arrangements, however, have not proven satisfactory for preventing dirt and debris from falling into the open end of the drop inlet, and they provide little or no protection against persons inadvertently falling into an open drop inlet, and especially for keeping children out of the inlet.

In fact, as shown in FIG. 2B, the known silt fences typically tend to collapse, be blown down, or washed down over a short period of time. This is due to the fact that the mesh of the silt fence and the stakes holding the silt fence in place are not strong enough to withstand heavy rains and wind, and even less so the force of dirt and debris being pushed against the silt fence by a motor grader or bulldozer as the streets and curbs of the site are graded. Under such weight, as illustrated in FIG. 2B, the silt fence generally will collapse, often falling into the open enci of the drop inlet itself thus permitting the accumulated dirt and debris being urged or pushed thereagainst to fall into the drop inlet.

Although the simplest solution to this problem would seem to be to completely seal the open end of the drop inlet, this is not feasible in that rain and storm runoff water must be permitted to drain through the storm water drainage system of the development during construction to permit the ground to dry, and to prevent storm water from eroding the work site and carrying soil and debris to adjacent lots or buildings. Also, the construction site must be kept as dry as possible in order to enable the curbs and throats to be poured and the streets to be finished, which cannot otherwise be accomplished if the ground is too wet to support the concrete as it is poured and formed, thus necessitating a good, open drainage system for the site.

Accordingly, a need exists for an apparatus to cover, protect and filter the drainage pipe of a detention pond and an open upper end of a drop inlet for a storm water drainage system at new construction developments. Also needed is a means for directing the water containing the solid particles to pass through a filtering means, rather than seep around it, thereby clogging drainage pipe or inlet and which at the same time controls the rate of water flow. Yet another need is a means for collecting or containing the "first flush" associated with the washing away of the oily residues on the soil.

SUMMARY OF THE INVENTION

The present invention includes a fluid distributing pan coupled to a silt guard or filtering device that fits over, seats upon, and is removably mountable to a drainage pipe for controlling erosion at construction sites and preventing oily residues and/or solid particles such as silt and other debris from collecting in water drainage pipes. More particularly, the present invention includes a silt-guard or filtering apparatus such as disclosed in U.S. Pat. Nos. 5,843,306 and 6,004,457, and in U.S. Pat. No. 6,261,445, the disclosures of which are incorporated herein by reference, which fits over and encloses the open end of an underground drainage pipe so as to trap and prevent the oily residues and/or solid particles from being washed into or being otherwise deposited within the pipe, while still enabling water to drain therethrough.

The fluid distributing pan of the present invention includes an orifice, preferably having a dimension sized smaller than an inside dimension of the drainage pipe. The fluid distributing pan may further include a fluid receiving body surrounding the orifice and a connecting member contiguous with the fluid receiving body. The fluid receiving body interposes the connecting member and the orifice. The orifice may be formed as an aperture or formed by an outlet tube. The connecting member functions to couple the silt guard to the fluid distributing pan to form the silt-guard apparatus, which is fitted over and seated upon the drainage pipe. In another embodiment the silt guard apparatus is interconnected and substantially sealed to the drainage pipe.

When present, the outlet tube will extend from the fluid receiving body and will be disposed within the drainage pipe. As water passes through the silt-guard apparatus, a resulting Venturi effect created by the difference in diameters of the fluid distributing orifice and the drainage pipe will cause the silt guard apparatus to substantially seal to the drainage pipe. The silt guard may be submersible.

The silt guard or filtering device useful in the present invention has a body portion, a top portion and a filter. The body portion has an open lower end attached to the connecting member of the fluid distributing pan, a spaced upper end, and a series of ribs extending between the upper and lower ends and defining passages therebetween. The top portion extends upwardly from the body portion. A filter is received over and supported by the top portion and overlaps the body portion for filtering solid particles and/or oily residues from the water passing therethrough and into the drainage pipe. The filter is formed from a porous filtering material.

DETAILED DESCRIPTION OF THE INVENTION

Figure 1A:
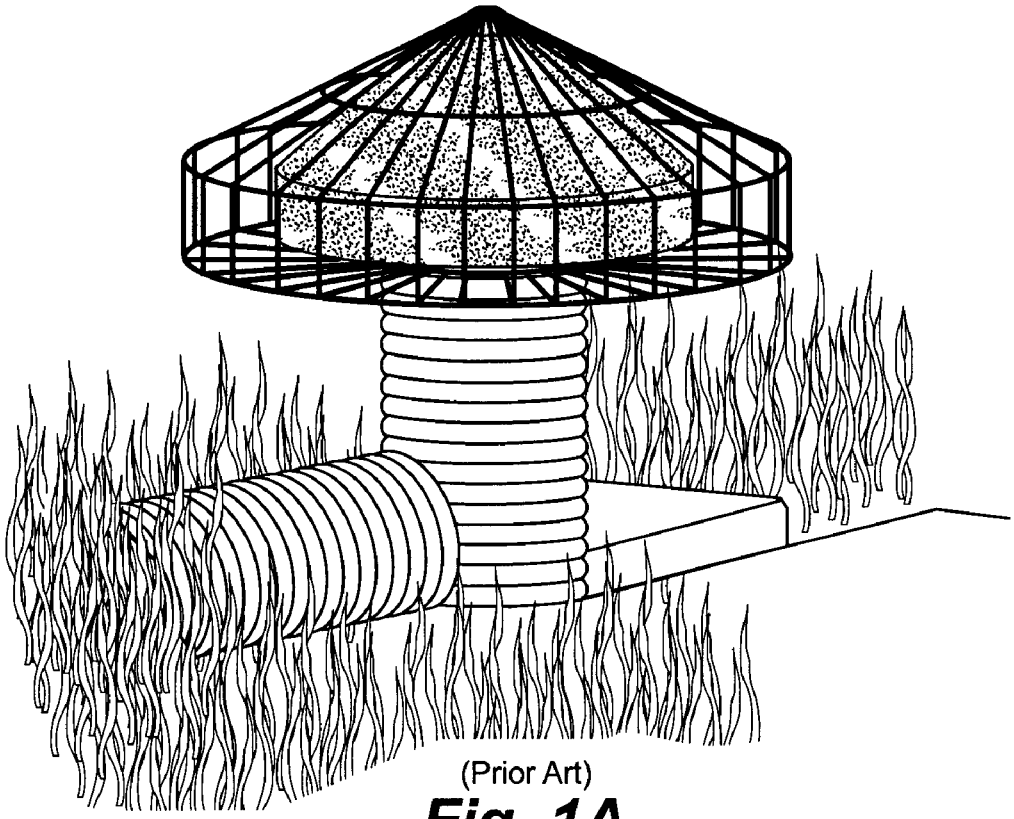
(Prior Art) Fig. 1A
FIG. 1A is a perspective view of a steel and gravel trash rack for use in a detention pond of the prior art.
Figure 1B:
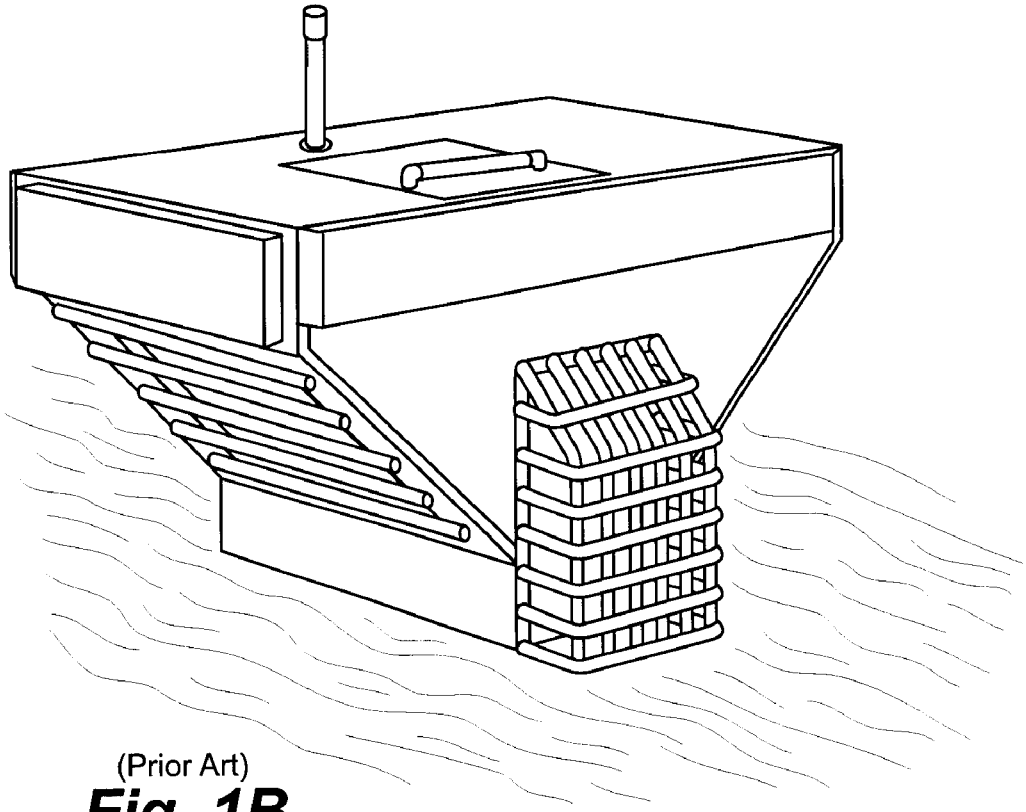
(Prior Art) Fig. 1B
FIG. 1B is a perspective view of a V-shaped weir for use in a detention pond of the prior art.
Figure 2A:
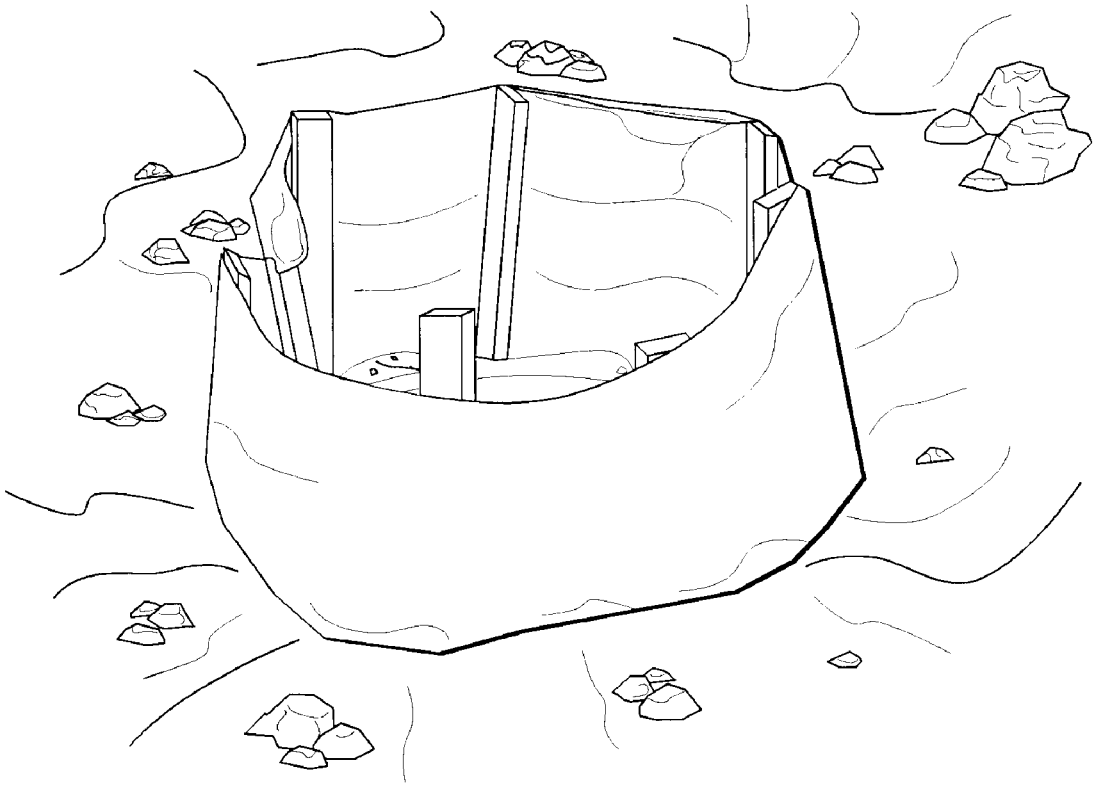
(Prior Art) FIG. 2A
FIG. 2A is a perspective view of a known silt fence arrangement for enclosing an open drop inlet.
Figure 2B:
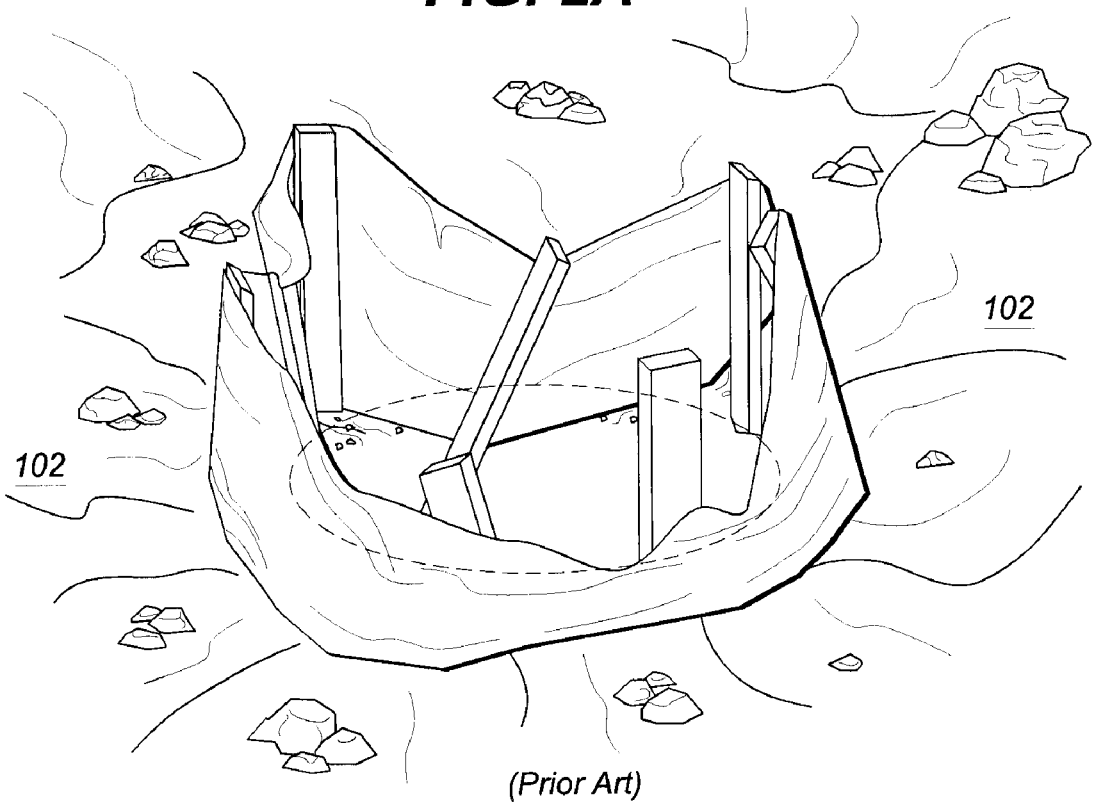
(Prior Art) FIG. 2B
FIG. 2B is a perspective view of a known silt fence arrangement for enclosing an open drop inlet, illustrating the tendency of such an arrangement to collapse as dirt and debris collects thereagainst.
Figure 3:
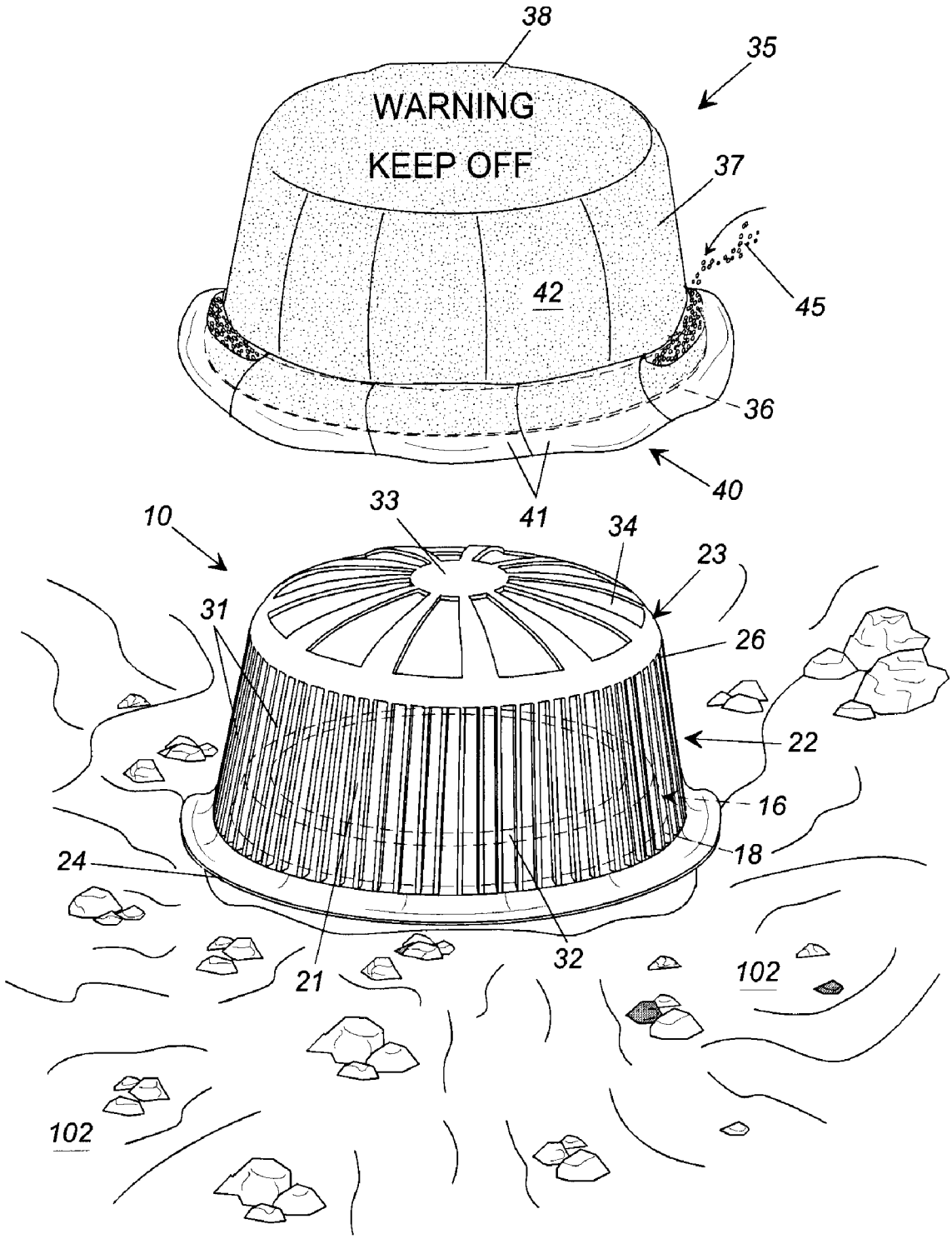
FIG. 3 is a perspective view illustrating the mounting of the silt guard with its filter over the open upper end of a drop inlet for a sewer or drainage system.

Referring now to the drawings in which like reference numerals indicate like parts throughout the several views, FIG. 3 illustrates a silt guard or filtering device 10 useful in the present invention, shown herein mounted over a drop inlet 11 of a storm water drainage system 12. The silt guard 10 generally is designed for temporarily (or even for extended time periods) covering and protecting an open drop inlet during the grading and construction of the road system for, as well as during additional site grading of, new residential or commercial construction development sites, and as the roads and curbs thereof are graded and poured, in order to prevent solid particles such as silt and debris from collecting within the underground drainage pipes 13 of the drainage system 12. Typically, the storm water drainage system will include underground concrete or metal drainage pipes 13, and/or collection boxes (not illustrated), with drop inlets 11 mounted thereto as illustrated generally in FIGS. 3 and 5. Even though the period of use of the silt guard 10 may be temporary, it will be understood by one of ordinary skill in the art that the silt guard may be reusable, as long as it is not substantially damaged between uses.

Turning again to FIG. 3, for instance, the drop inlets 11 of the drainage system 12 typically are hollow, substantially cylindrical pipes made from concrete and are mounted vertically with an open lower end 14 connected to one of the drainage pipes 13 of the system, with an open upper end 16 generally left approximately at or above ground level. The upper end 16 of the drop inlet generally includes an inwardly tapering upper portion 17 that defines an upper opening through which water is permitted to drain into the drainage system, and an upper rim 18 encircling the tapered upper portion 17. After the throats and curbs of the street are poured, the open upper ends of the drop inlets typically form the manholes or curb drains for the street. The silt guard apparatus 100 of the present invention may be adapted to interconnect with a drop inlet 11, or simply to a drainage pipe 13.

Figure 4:
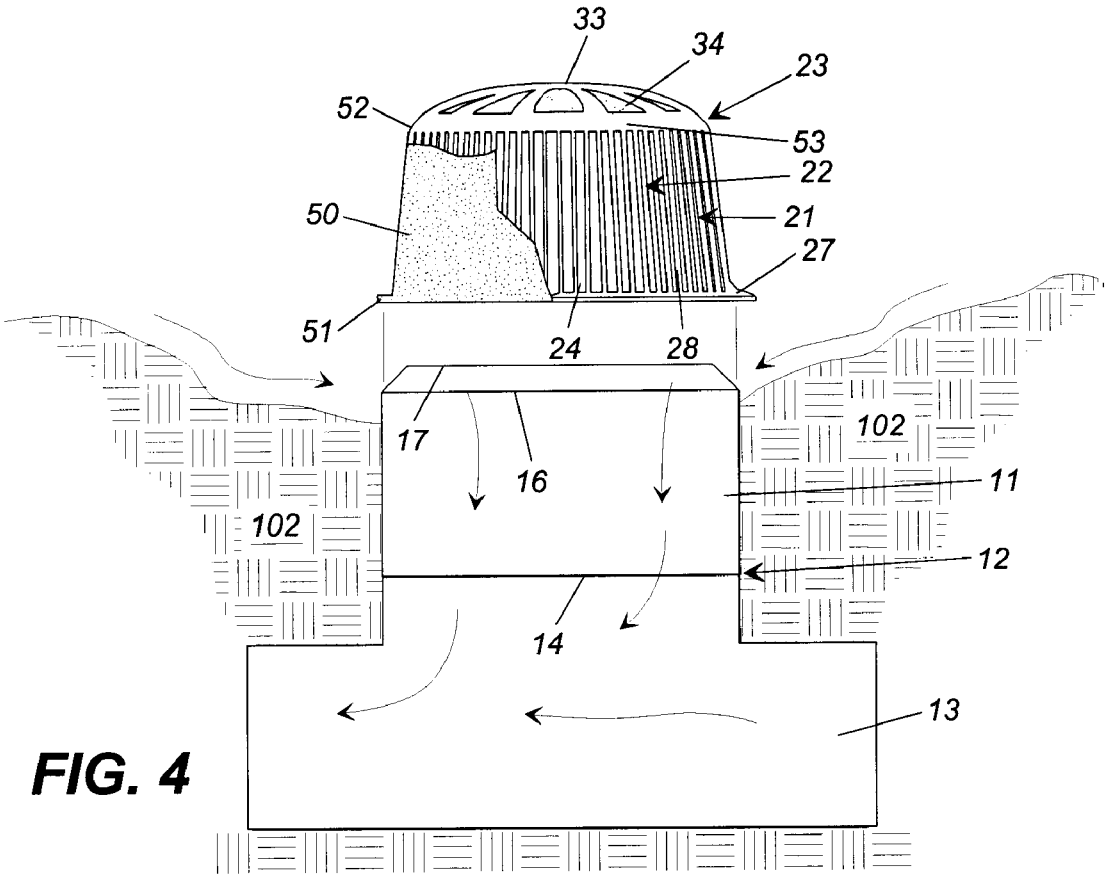
FIG. 4 is a side elevational view of the silt guard mounted on top of a drop inlet showing the filter material wrapped thereabout.
Figure 5:
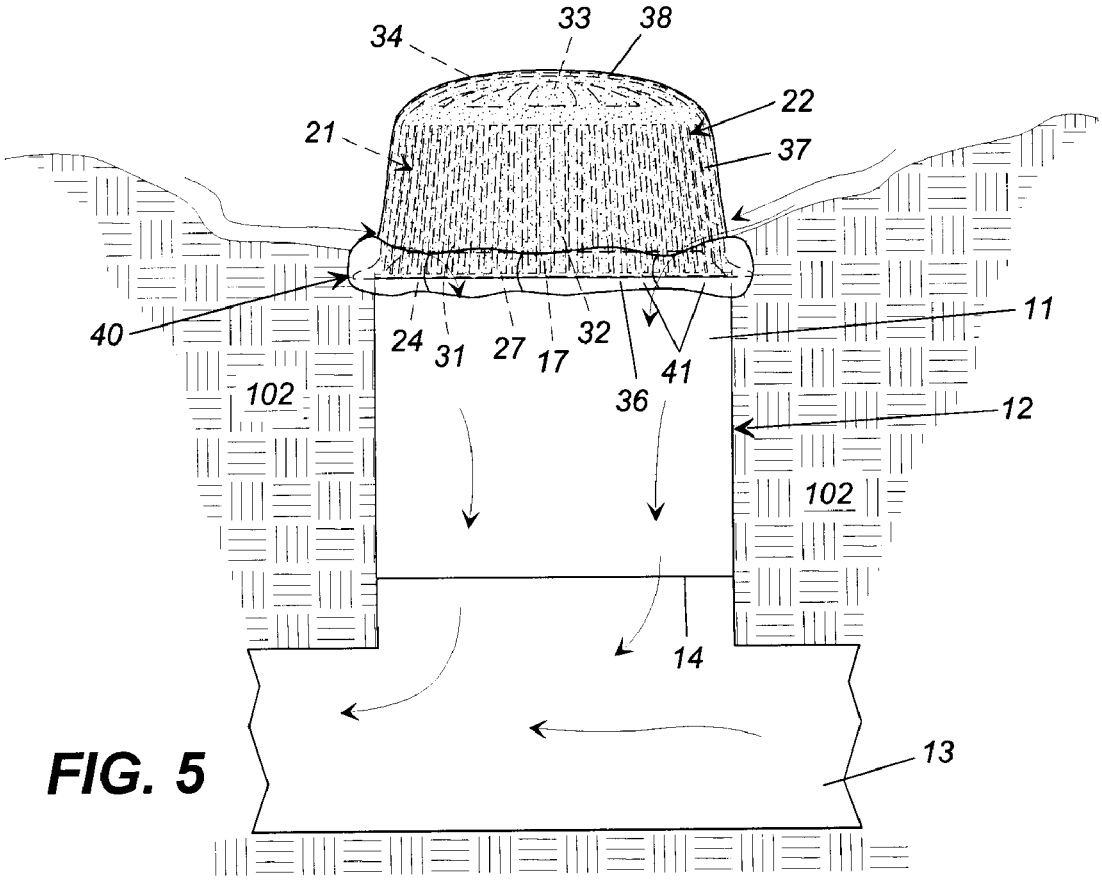
FIG. 5 is a side elevational view of the silt guard mounted on a drop inlet and illustrating the flow of water therethrough while dirt and debris are piled up thereagainst.

To temporarily enclose and prevent inadvertent or unauthorized entry into open drop inlets during construction, while still enabling storm runoff water to drain into the drainage system, the silt guard 10 useful in the present invention would typically be mounted over the open upper end of the inlet as illustrated in FIGS. 3–5. The silt guard 10 generally is substantially cylindrical in fashion similar to the drop inlet 11 on which it is typically mounted, and is approximately two to three feet in height. The silt guard would thus extend well above the open upper end 16 of the drop inlet 11 to provide a visual indication or marker of the location of the drop inlet. As shown in FIG. 3, the silt guard is typically sized and shaped to fit over and seat upon the upper rim 18 of most conventional drop inlets 11.

As shown in FIG. 3, the silt guard 10 generally includes a lower or body portion 22 with a top portion 23, typically formed as a part of the body portion, extending upwardly from body portion 22. The body portion 22 of the silt guard 10 generally is approximately 18 to 28 inches in height, with an open lower or first end 24 and an upper or second end 26. As FIG. 3 indicates, the body portion may be formed as an elongate tubular member as substantially tubular or cylindrical and tapered or inclined from lower end 24 toward upper end 26 in order to enable additional silt guards to be stacked thereon for ease of storage and transport. The lower end 24 will be adapted such that the connecting member 74 of the fluid distributing pan 70 may be attached thereto.

Preferably, a bottom rim 27 is formed about the lower end 24 of the body portion 22. The bottom rim 27 is typically substantially circular and is generally flared outwardly with a thickness of approximately ⅜ to 1 inch, and an outer diameter of approximately 48 to 60 inches. It will be understood that the bottom rim 27 also can be formed with a substantially flat configuration.

The bottom rim 27 defines a lower opening or passage 28 typically having an internal diameter of approximately 46 to 58 inches through which runoff water passes into the drop inlet or drainage pipe. The diameter of the passage 28 can be further varied depending on the size of the opening of the drop inlet or drainage pipe and to restrict the flow of runoff water if desired. In one silt guard embodiment and as shown in FIGS. 3 and 4, the bottom rim 27 projects radially outwardly from the bottom most portion of the body portion 22 of the silt guard 10 by approximately 1 to 3 inches, so as to be adaptable to fit over and seat upon the upper rims 18 of drop inlets 11 having concrete risers of various sizes and constructions. This configuration typically ensures that the silt guard 10 would be securely positioned over the open upper end 16 of the drop inlet 11 with the open upper end of a drop inlet extending into the open lower end 24 of the silt guard to prevent the silt guard from sliding or otherwise being easily dislodged from the upper end of the drop inlet. It is also possible for the bottom rim 27 to be formed in other configurations or shapes, such as, for example, being substantially flat to seat against a flat or otherwise configured outer rim formed about the open upper end of a drop inlet.

The silt guard 10 further defines an internal passage 21 (FIGS. 3 and 4) therethrough in which storm runoff water is permitted to pass and drain into the drop inlet or drainage pipe, and thus into the drainage system of the development. The body portion 22 generally includes a spaced series of elongate slats or ribs 31 defined within the body portion 22, extending between the upper and lower ends 24 and 26 of the body portion. It is anticipated that slats 31 will be approximately ½ to 3 inches in width, and define radially spaced openings or passages 32 of approximately 1 to 2 inch widths therebetween. The passages 32 enable water to drain through the body portion and into the internal passage 21 of the silt guard 10, as illustrated in FIG. 5. It also will be understood that the dimensions of slats 31, and of openings/passages 32 may be varied in accordance with the needs of the users of the silt guard to provide larger or smaller passages such that larger slots or slots having various configurations such as rectangular or triangular, so as to provide a larger open area at the upper ends of the passages also can be used, as desired. As shown in FIGS. 3 and 5, the slats 31 typically slant inwardly toward the upper end 26 of the body portion 22 from the lower end 24 so as to provide a tapered construction for ease of stacking multiple silt guards one on top of another.

As illustrated in FIGS. 3–5, the top portion 23 of the silt guard 10 is formed over and extends upwardly from the upper end 26 of the body portion 22, and has a reduced diameter compared to the diameter of upper end 26 of the body portion 22. The top portion 23 generally is slightly curved or domed, forming a curved or domed top end 33, although it can be flat if so desired, and is approximately 6 to 10 inches high and approximately 40 to 48 inches in diameter. The top portion 23 covers or encloses the body portion 22 of the silt guard 10 and also can be reinforced to support added weight. As a result, access into the drop inlet 11 or drainage pipe 13 is generally barred or blocked to substantially minimize the risk of inadvertent or unauthorized access.

A series of radially spaced slots 34 or upper openings are formed in the top portion 23. The slots 34 are elongated, substantially rectangularly shaped openings that extend at least partially across the top portion 23 and provide additional passageways for overflow storm runoff into the drop inlet or drainage pipe, when and as needed. A single, substantially centrally located opening also can be used in place of or in conjunction with the slots 34. In addition, the slots also enable a pipe or bar to be inserted therethrough to provide a means by which the silt guard can be lifted upwardly off of the drop inlet or drainage pipe after use, i.e., after project completion or dismantling of the detention pond.

As illustrated in FIGS. 3 and 5, a filter 35 is received over the silt guard 10, generally covering the silt guard. The filter 35 is received over and supported by the top portion 23 of the silt guard 10 and overlaps the body portion 22. The filter 35 performs multiple functions including controlling the water flow rate through the silt-guard apparatus, actively filtering the solid particles from the water passing therethrough, and "cleaning" the oily residues from the water. As discussed in detail above, a means for collecting or containing the "first flush" associated with the washing away of the oily residues on the surface of the soil is important in construction sites and to keep from polluting the drainage system.

The filter 35 is formed from a porous filtering material 42, such as a material made of polyester, for example, polyethylene terephthalate, polyolefin, for example, polyethylene and polypropylene, polyamide, for example, nylon 6 and nylon 66, or a conventional silt screen or mesh material of the type known to those of skill in the art, and can also include a plastic, nylon, or wire mesh, or other similar filtering material or fabric. The filtering material may include a geotextile, woven, nonwoven or knitted material. Preferably, the porous filtering material is formed from a nonwoven material, such as polyethylene, to enable water to pass therethrough easily, while the solid particles and/or oily residue are filtered out. Further, the solid particles typically do not appear to have an affinity for materials such as polyethylene, so instead of remaining on the surface of the filter material and clogging the filter, the solid particles will eventually fall away from the surface, thereby leaving the filter unobstructed. As used herein, the term "nonwoven" means a material having a structure of individual fibers or threads that are interlaid, but not in an identifiable manner as in a knitted fabric. Nonwoven materials have been formed from many processes such as for example, bonded carded web processes, meltblowing processes and spunbonding processes.

The filter 35 is generally formed as a substantially cylindrical sheet or cover and is sized and shaped to fit over the silt guard 10 with its lower edge 36 overlapping the bottom rim 27 of the body portion 22. Typically, the filter 35 will be cut or formed from sheets of the filtering material 42 sewn together to form a skirt or filter body portion 37 and a filter top portion 38, or otherwise attached in a configuration similar to that of the silt guard so as to substantially match the profile of the silt guard. It is also possible to form the filter 35 from a single sheet of filtering material sized and shaped to drape over and cover the silt guard.

The filter top portion 38 of the filter 35 rests and is supported on the top portion 23 of the silt guard 10, with the silt screen material of the skirt or filter body portion 37 covering and being laterally supported by the slats 31 of the body portion 22 of the silt guard 10. As shown in FIG. 5, the lower edge 36 of the filtering material 42 of the filter 35 is left overlapping the bottom rim 27 of the silt guard 10 by approximately 3 to 6 inches or more. As FIGS. 3 and 5 illustrate, a support ring or tube 40 may be attached or formed about the lower edge 36 of the skirt or filter body portion 37 of the filter 35.

The support ring 40 generally is formed from a heavy, durable material such as a heavy plastic or rubberized material that typically is sewn or otherwise attached to the skirt portion 37 of the filter 35 so as to surround the lower edge 36 thereof. It will also be understood by those skilled in the art that other types of materials including heavy mesh or silt screen materials also can be used to form the ring or tube 40 to enable water to pass therethrough. As seen best in FIG. 3, the ring or tube 40 is typically open along a top or upper edge thereof and typically can be attached to the skirt portion 37 of the filter 35 at various spaced locations about its circumference to define an elongated, open-ended pocket or a series of pockets 41 spaced about the skirt portion 37 of the filter 35. Stone, dirt, sand, or similar filler material 45 is placed within the pocket(s) 41 of the ring 40 to provide additional weight and support for holding the filter 35 on the silt guard 10 to prevent the filter from being dislodged from the silt guard under high winds or excessive water run-off. Accordingly, once the silt guard 10 is installed over the upper end 16 (FIG. 3) of a drop inlet 11, the upper end of the drop inlet is likewise overlapped by the (FIG. 3) lower edge 36 and ring 40 of the filter 35 as shown in FIG. 5. The filter 35 is held in place initially by filler material 45 (e.g. stone and/or dirt) placed within the ring 40 by workers during the installation of the silt guard 10 and is further secured against the silt guard by the silt and debris washed thereagainst and which the filter prevents from flowing into the drop inlet or drainage pipe with the runoff or storm water passing through the silt guard.

As shown in an alternate embodiment illustrated in FIG. 4, it is also possible to use a sheet or roll of conventional silt screen material, as indicated at 50, that is wrapped about the slats 31 of the body portion 22, instead of using a pre-formed filter 35 as illustrated in FIGS. 3 and 5. The silt screen material typically is rolled or wrapped about the body portion 22 of the silt guard 10, as shown in FIG. 4, with its lower edge 51 overlapping the bottom rim 27 of the body portion approximately 3 to 6 inches. The upper edge of the silt screen material 50 typically will be secured to the top portion 23 of the silt guard 10 by a series of fasteners 53 such as screws or hooks, or other types of fastening devices including adhesives and metal bands or ties to secure the upper edge of the silt screen material to the silt guard.

In addition, the top portion 37 of the filter 35 (FIGS. 3 and 5) can also be dyed or painted with a fluorescent color, such as a bright orange or red, either at its center or in its entirety. This will make the filter and thus the silt guard itself stand out more prominently and provide a clear and easy to recognize visual indicator of the existence and position of the drop inlet or drainage pipe for workers. If the filter is replaced with the application of a sheet of silt screen material about the body portion only, the domed top portion of the silt guard itself can be painted a fluorescent color to make it more recognizable and identifiable.

Figure 6:
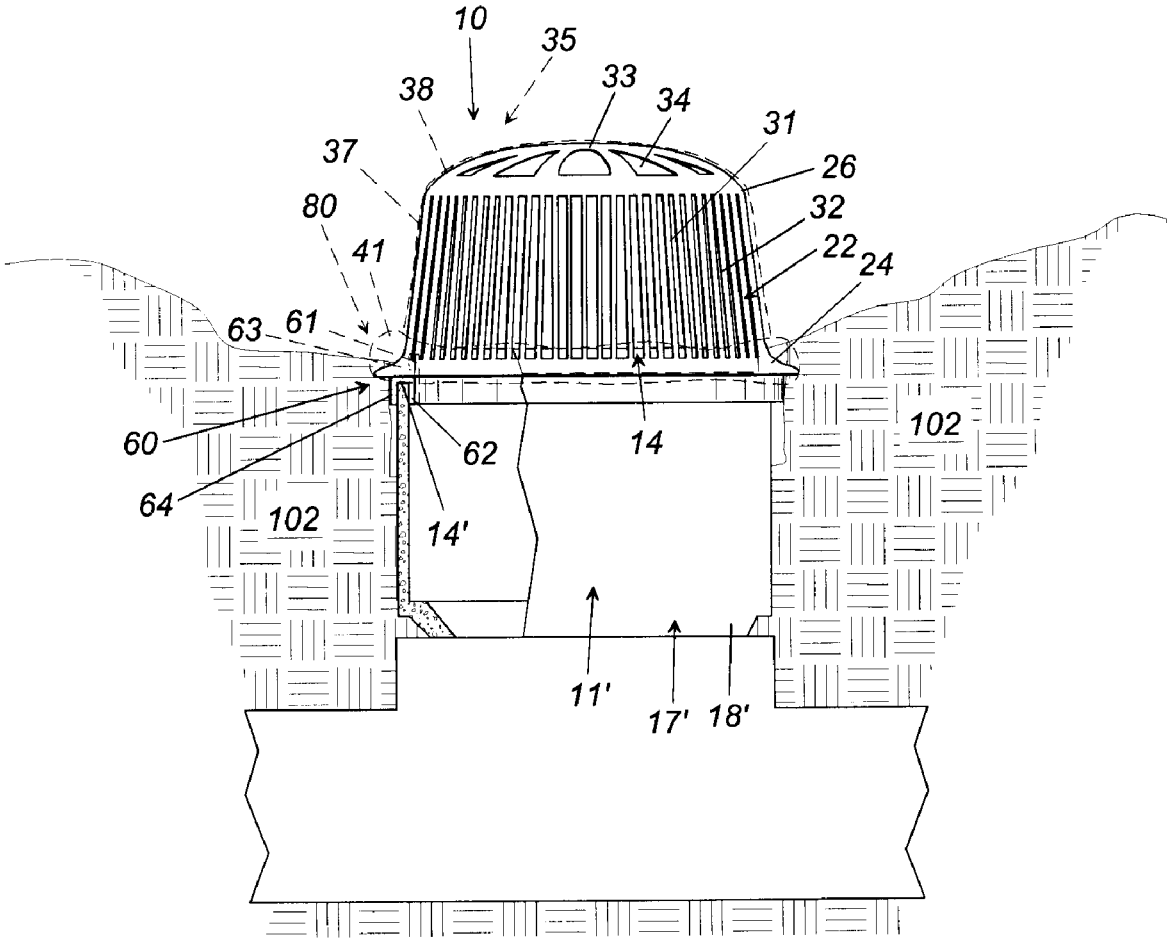
FIG. 6 is a side elevational view taken in partial cross-section of the silt guard with a mounting bracket for mounting the silt guard on an inverted drop inlet.

Alternatively, there are times when the storm water drop inlet 11' is installed in an inverted condition, as illustrated in FIG. 6. As a result, the flat, bottom or female edge 14' of the drop inlet is left facing upwardly, with the tapered upper portion 17' and rim 18' of the drop inlet facing downwardly. Under such circumstances, a bracket 60 may be mounted on the upwardly facing bottom edge 14' of the drop inlet to provide a seating mechanism for mounting the silt guard 10 on the drop inlet 11'. As FIG. 6 illustrates, the bracket 60 has a generally H-shaped cross-section and is of the same approximate diameter and size as conventional drop inlets. The bracket includes a first or inside leg 61 that has a lower portion 62 that projects into and typically engages the inner side wall of the drop inlet and an upper portion 63 extending above the flat bottom edge 14' of the drop inlet. A second or outside leg 64 extends over the bottom edge, projecting outwardly from the inside leg so that the bracket can engage and be seated upon the upwardly facing bottom edge 14' of the drop inlet. With the bracket 60 thus positioned on the drop inlet, the silt guard could be seated on the bracket with the upper portion 63 of inside leg 61 projecting into the silt guard adjacent the inner side surfaces of the slots 31. The bottom rim of the silt guard could be seated on the outside leg to thus provide a stable, secure mounting of the silt guard on an inverted drop inlet, as indicated in FIG. 6.

In use, as illustrated in FIGS. 3 and 5, once the underground pipes 13 of the drainage system 12 have been laid, and the drop inlets 11 have been connected thereto, silt guards 10 of the present invention will be placed one apiece atop the upper end 16 of each drop inlet 11 forming a part of the storm water drainage system. Once the silt guard is in position, the filter 35 will be placed thereover. If a sheet of silt screen material 50 (FIG. 4) is used in place of the filter 35 (FIGS. 3 and 5), it is anticipated that the silt screen material generally will have been first secured about the body portion 22 of the silt guard 10 prior to the installation of the silt guard atop the open upper end of the drop inlet, although it is possible to first mount the silt guard on the drop inlet and to then install the silt screen material about the body portion.

The silt guard 10 is installed over the open upper end 16 of the drop inlet 11 with bottom rim 27 of the silt guard seated on the upper rim 18 of the drop inlet, and with the upper portion 17 of the drop inlet projecting upwardly within and being received in the lower opening 28 of the silt guard. This provides a stable, substantially secure mounting of the silt guard on the open upper end of the drop inlet and minimizes the possibility that the silt guard may be dislodged or blown off of the drop inlet. Once installed, the filter 35 is placed over the silt guard 10, covering and overlapping the silt guard. Workers then will place stones and/or dirt within the pockets 41 of the ring 40 attached about the periphery of the filter 35, covering the overlapped lower edge of the silt guard to hold the filter in place on the silt guard, and to help hold the silt guard itself in position on the drop inlet.

Thereafter, as the grading of the sites and roadbeds is completed, and the curbs for the streets are then graded, the dirt and debris which typically is pushed up against the silt guard by the motor graders or bulldozers will be held out of drop inlet 11 and pipe 13 as shown in FIG. 5. The porous filtering material of the filter thus is further held against the slats of the body portion by the silt and debris it filters from the runoff water while it permits the runoff water to pass therethrough and to drain into the drop inlet, preventing the silt and debris from passing into the drop inlet. The slats or ribs of the silt guard provide the strength and rigidity needed to support the silt screen material of the filter skirt portion against the weight of the accumulated dirt and debris pushed thereagainst, which thus prevents the probable collapse of the silt screen material as now occurs in the art. At the same time, however, the added weight of the dirt piled against the silt guard, in addition to the stone and dirt within the pockets of the ring, serves to further secure and hold the filter against the silt guard and the silt guard against the open upper end of the drop inlet to prevent the silt guard from being dislodged by wind and rain. Thus, the drop inlet is kept substantially free of dirt and debris during the grading of the site, as well as of the project curbs and streets, while rain and runoff water is permitted to pass through the filter of the silt guard and into the drop inlet where the runoff water can drain through the drainage system.

Once the curbs have been graded, any excess dirt around the silt guard and upper end of the inlet will be dug out as part of the process for forming and pouring the throats and manholes about the upper ends of the drop inlets. After the excess dirt has been removed from about the drop inlets, the stone, dirt or other filler material is removed from the ring, or the ring is cut away, after which the used filter generally is peeled or otherwise stripped off of the silt guard and disposed of, if it cannot be cleaned and reused. The silt guard 10 itself is lifted off of the drop inlet and hosed or washed down to clean excess dirt and debris therefrom, leaving the silt guard ready for its next use. In some instances where it is difficult to clear away enough debris to easily remove the silt guard, a pipe (not illustrated) or similar bar generally can be inserted through opposing ones of the slots 34 defined within the top portion 23 of the silt guard to pry the silt guard from the drop inlet.

The procedure for setting up and monitoring a storm water discharge system, is set forth according to applicable Environmental Protection Agency (EPA) guidelines, and may also be regulated by state and local agencies. For instance, Georgia publishes the Manual for Erosion and Sediment Control (GaSWCC Amended-2000) and a field manual covering the same topics, which prescribes the requirements in the State, the manual being incorporated herein by reference in its entirety.

The Clean Water Act prohibits any discharge into the waters of the United States unless a National Pollution Discharge Elimination System (NPDES) permit authorizes the discharge. (Storm Water Phase II, Final Rule, Small Construction Program Overview, EPA 833-F-00-013, January 2000, Fact Sheet 3.0.) The EPA promulgated rules establishing a NPDES storm water program in 1990 and 1999. The Phase I rule, in 1990, required a permit for "large-scale" construction activities, defined as those which disturb five acres or greater of land. The Phase II rule, in 1999, required a permit for smaller construction activities, defined as those which disturb between one and five acres of land, or those that are part of a larger plan or development that will disturb between one and five acres of land. The specific contents of the NPDES permit are left to the NPDES permitting authority in each state; however, the procedure and guidelines remain fairly similar.

The procedure under the EPA regulations generally includes the following steps. First, a Storm Water Pollution Prevention Plan (SWPPP) must be developed and implemented. The SWPPP requirements are flexible, in order to accommodate the different needs of the particular construction location. In determining what should comprise the SWPPP for a project, the construction operator should consider local development requirements, precipitation patterns, soil types, slopes, layout of structures for the site, sensitivity of nearby water bodies, safety concerns, and coordination with other site operators. (Reissuance of NPDES General Permits for Storm Water Discharges from Construction Activities, 63 Fed. Reg. 7858, 7860 (1998).) Generally, the SWPPP must contain (1) a site description that identifies sources of pollution, (2) a description of measures that will be used on site to combat pollution from storm water, (3) a description of maintenance and inspection procedures, and (4) a description of pollution prevention measures from non-storm water discharges that may be present.

A topographic map initially is made of the site, identifying soil type, runoff water quality, and location of receiving water. Additionally, the construction activity should be described, including slopes after grading, disturbed areas, and drainage patterns. Sediment and erosion controls combat pollutants in storm water generated during active construction work. Sediment controls attempt to remove sediment from runoff before the runoff is discharged from the site. Erosion controls attempt to prevent erosion through protection and preservation of soil. Sediment and erosion controls are divided into two types: stabilization practices and structural practices.

Stabilization refers to maintaining the groundcover on the construction site. Groundcover reduces the potential for erosion and, correspondingly, the level of sediment in runoff water. Stabilization practices include: temporary seeding, permanent seeding, mulching, sod stabilization, vegetative buffer strips, preservation of trees, and contouring. Structural practices involve the installation of devices to divert, store, or limit runoff. "All structural practices require proper maintenance (e.g. removal of collected sediment) to remain functional and should be designed to avoid presenting a safety hazard—especially in areas frequented by children. (63 Fed. Reg. 7862 (Feb. 17, 1998) (emphasis added).) Examples of structural practices are earth dikes, silt fences, drainage swales, sediment traps, check dams, level spreaders, subsurface drains, pipe slope drains, temporary storm drain diversions, storm drain inlet protections, and rock outlet protections, among others.

Storm water management measures are installed just before completion of construction activities, to control pollutants in storm water discharged after construction activities have ceased. These measures include on-site infiltration, flow attenuation by vegetation or natural depressions, outfall velocity dissipation devices, retention structures, and water quality detention structures.

A comprehensive SWPPP also includes measures designed to promote effective housekeeping during the construction process in order to prevent the inadvertent introduction of pollutants from construction materials. Examples of these measures include a specific area for equipment maintenance and repair, waste receptacles and collection of waste, protected storage areas for paint and other toxic materials, and adequately maintained sanitary facilities.

The operator generally must inspect the area at least once every 14 days and within 24 hours of a major rainfall, under the EPA guidelines. This inspection should include at least a visual determination of whether sediment is being introduced at the discharge points. If inadequacies are found, the SWPPP must be amended and reimplemented. A report detailing these inspections must be maintained with the permit for up to three years after the site has been finally stabilized. These inspections should be conducted pursuant to an inspection plan developed as part of the SWPPP.

The permit also requires that the construction operator report a discharge of hazardous substances in excess of limits set forth in the Code of Federal Regulations. The operator must also amend the SWPPP to include the date and description of the release as well as response to the release and measures to prevent future releases. Additionally, the operator must insure that the usefulness of the controls is not impaired by accumulation of sediment. Therefore, a Notice of Termination must be submitted when final stabilization of the site has been achieved, meaning when a uniform perennial vegetative cover exists for the non-structural or pavement areas of the construction site.

As a means for complying with these types of regulations, FIGS. 7–12 illustrate an additional embodiment of a silt guard apparatus or retention structure 100 of the present invention for use in filtering oily residues, and/or solid particles 102 (e.g. sediment, concrete and the like) from a flow of water (including storm water and shown by the arrows) from a detention pond or water collection area 80, shown here with a drainage pipe 13. The silt guard apparatus 100 (FIGS. 7–9 and 12) may include a fluid distributing pan 70 coupled to a silt guard or filtering device 10, the apparatus then being fitted over, seated upon, and removably mountable to the drainage pipe 13.

Figure 7:
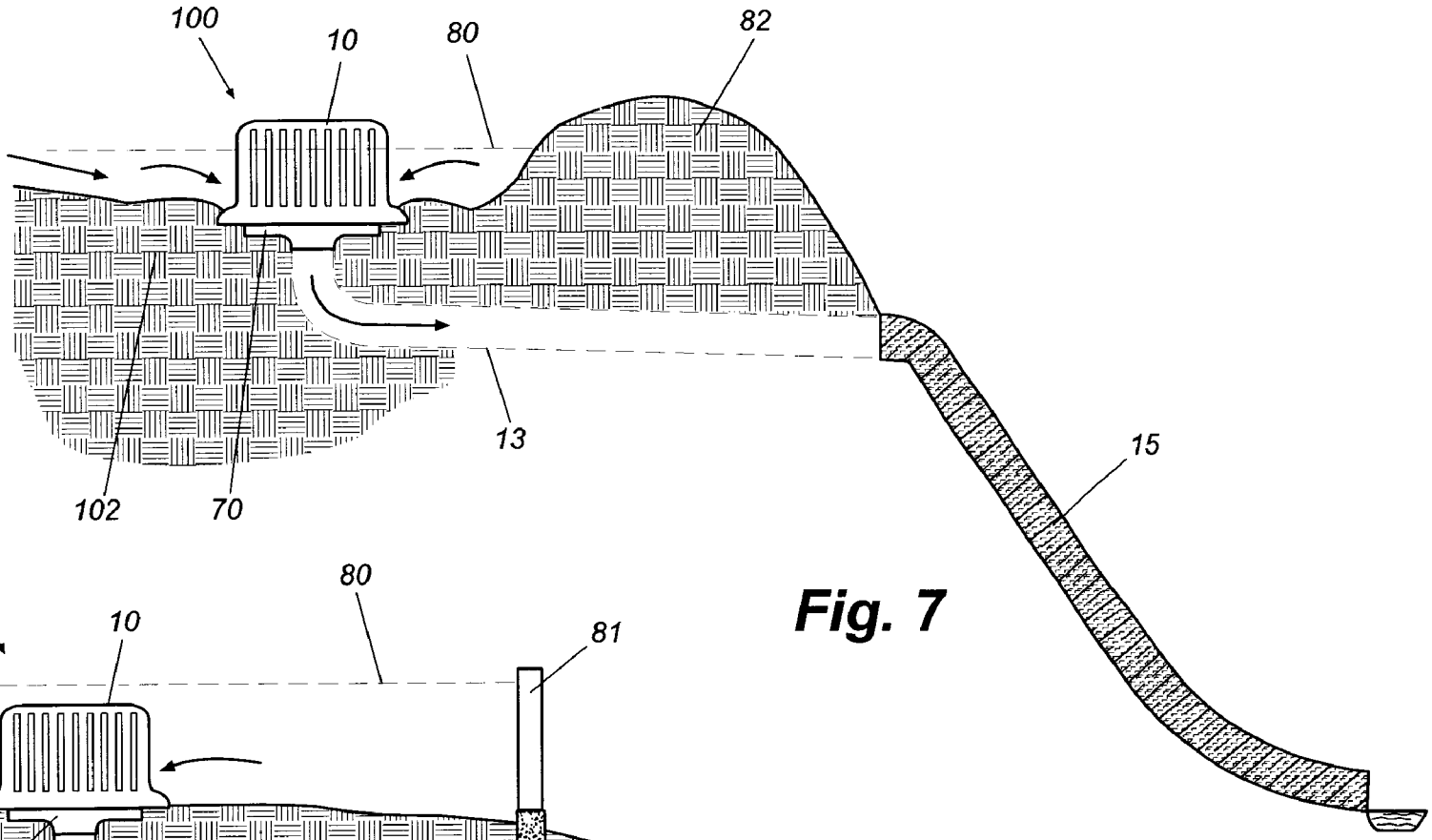
FIGS. 7 and 8 are side elevational views of the silt-guard apparatus of the present invention, shown without a filter, in use in a detention pond.
Figure 8:
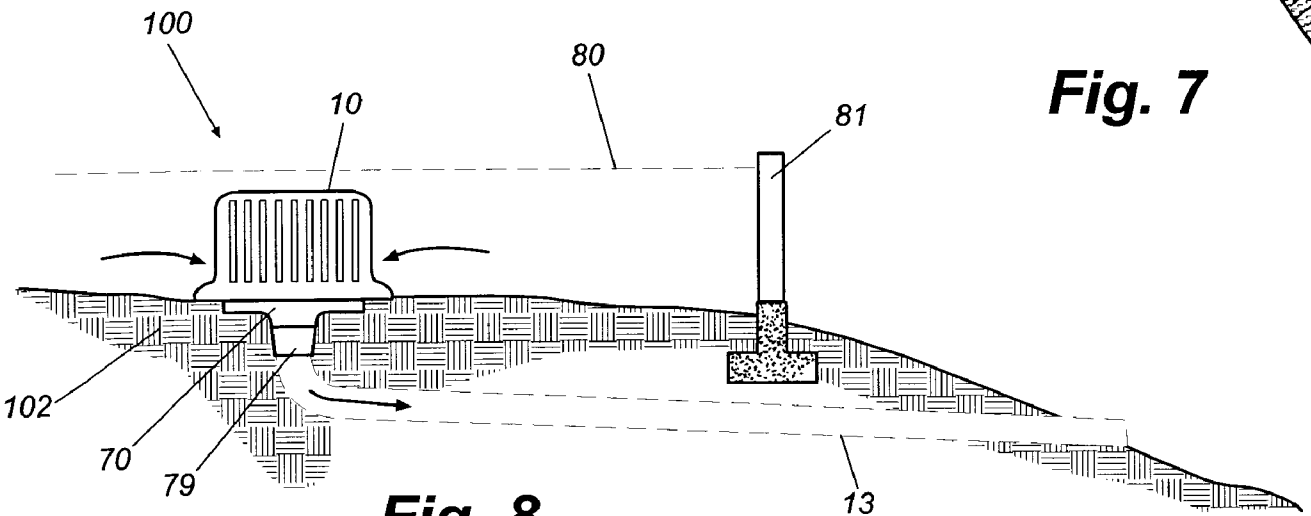

The silt guard apparatus 100 is designed for use in, for instance, a detention pond 80 as can be seen in FIGS. 7 and 8. In FIG. 7, the detention pond 80, in this case, a temporary sediment basin such as created by excavation of a basin, typically is formed at a naturally low point of the site with an earthen berm 82 to facilitate retention of the water, while the detention pond 80 of FIG. 8 illustrates the use of a dam or weir 81. A drainage pipe 13 (including an elongated cylindrical standpipe if necessary) extends downwardly from the low point of the detention pond 80, while the silt guard apparatus 100 attaches to the top of the drainage pipe 13. Additionally, the drainage pipe 13 may have a flexible down drain pipe 15 (FIG. 7) extending from the drainage pipe 13. In function, the silt guard apparatus 100 fits over and seats upon the drainage pipe 13, forcing the water to pass through the apparatus prior to entering the drainage pipe, thereby filtering oily residues and/or solid particles such as silt and debris from the water. In this way, there exists a means to provide erosion control in such construction site ponds because the silt will remain in the detention pond, rather than be washed away from the site. Further, the drainage pipe itself will not become clogged by the silt and debris.

Figure 9:
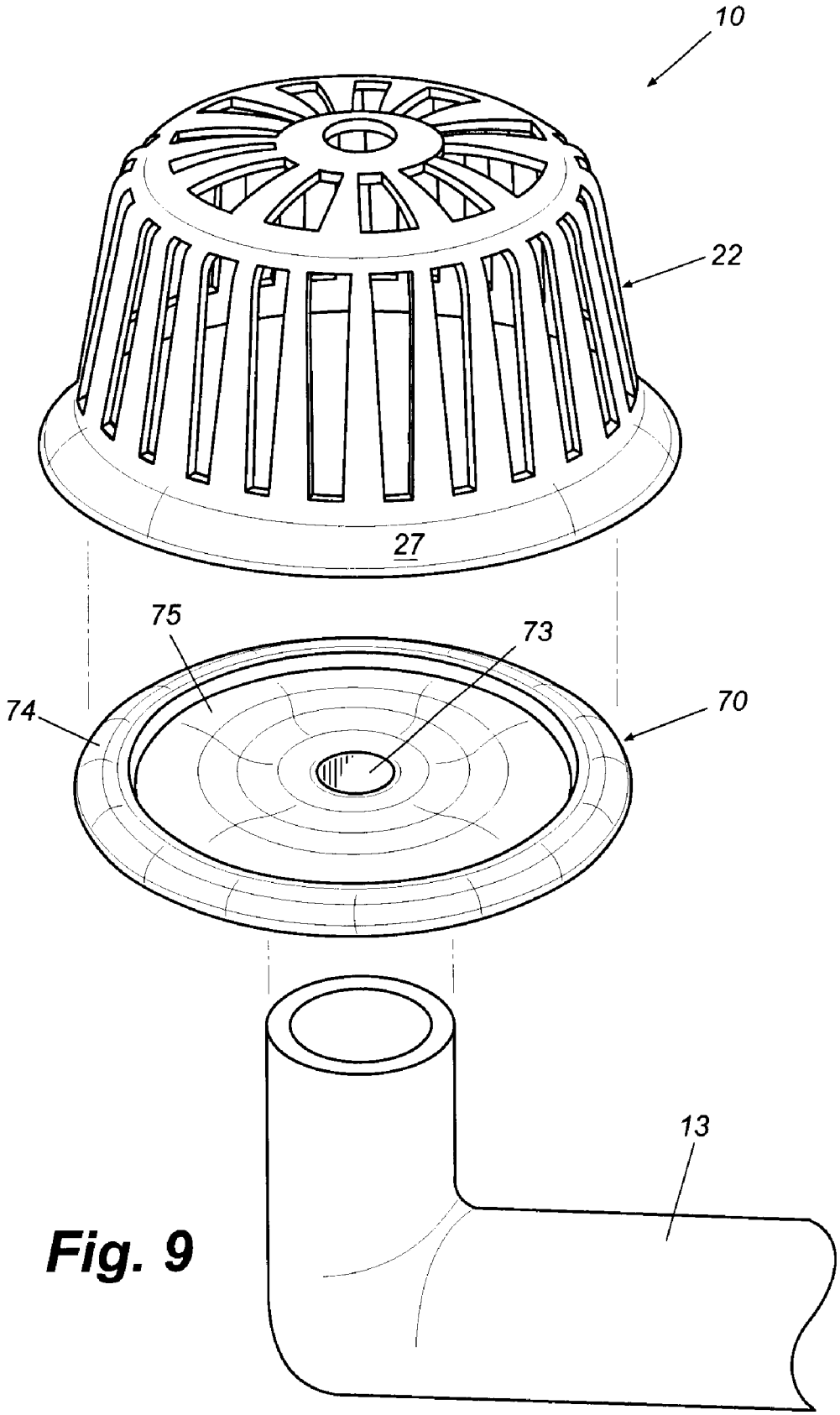
FIG. 9 is an exploded perspective view of silt guard apparatus of the present invention including the silt guard and fluid distributing pan in communication with a drainage pipe.
Figure 10:
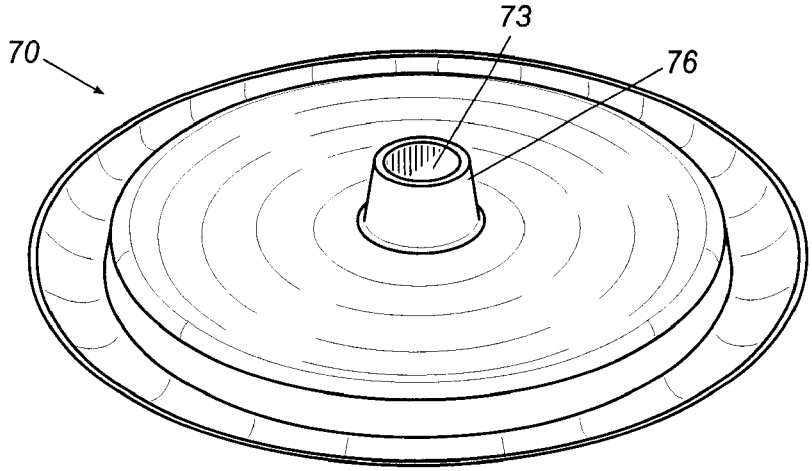
FIG. 10 is a perspective view of the bottom surface of the fluid distributing pan in accordance with one aspect of the present invention.
Figure 11:
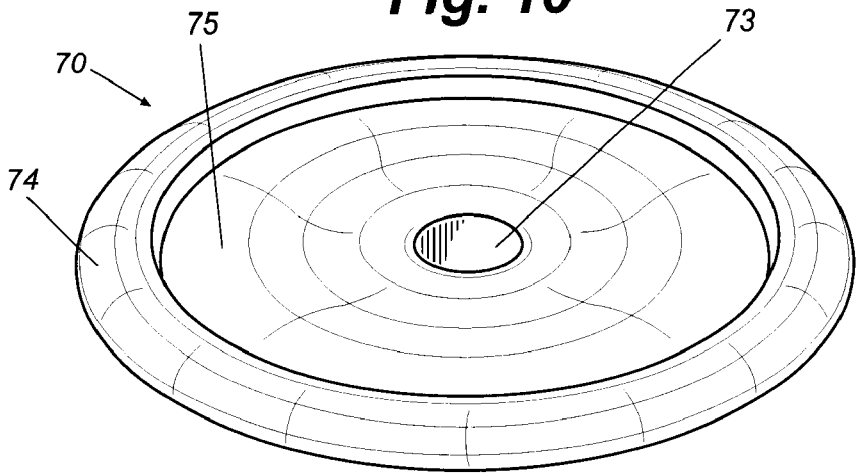
FIG. 11 is a perspective view of the top surface of the fluid distributing pan in accordance with one aspect of the present invention.

Turning to FIGS. 9–12, there is shown a fluid distributing pan 70 of the present invention for seating the silt guard 10 on the drainage pipe 13. The fluid distributing pan 70 generally is formed from a plastic or similar rigid, durable material and is shaped according to the specific intended application, including being substantially rectangularly shaped (not shown), square (not shown), or substantially circular (e.g. ring-shaped). Typically, in the center of the fluid distributing pan 70, (although not necessarily centered), is a fluid distributing orifice 73 (FIGS. 9–11). The orifice 73 may be formed simply as an aperture of varying size and/or configuration, or alternatively, it may be formed from the opening in an outlet tube 76 (see particularly FIG. 10). Surrounding the orifice 73 is a fluid receiving body 75 (FIGS. 9 and 11). When included in the structure, the outlet tube 76 extends from the fluid receiving body 75 to form the fluid distributing orifice 73. Contiguous with the fluid receiving body 75, opposite the orifice 73, is a connecting member 74. The fluid receiving body 75 is positioned such that it interposes (i.e. is situated between) the connecting member 74 and the orifice 73. The connecting member 74 functions to join or fasten together the silt guard 10 and the fluid distributing pan 70 as shown in FIGS. 12 and 13*a*–13*d*. Although not shown, reinforcing supports may be necessary to provide rigidity to and maintain the shape of the fluid distributing pan 70. Such reinforcing supports may, for instance, take the shape of support members formed in or attached to the underside of the fluid receiving body 75 and/or the connecting member 74.

Figure 12:
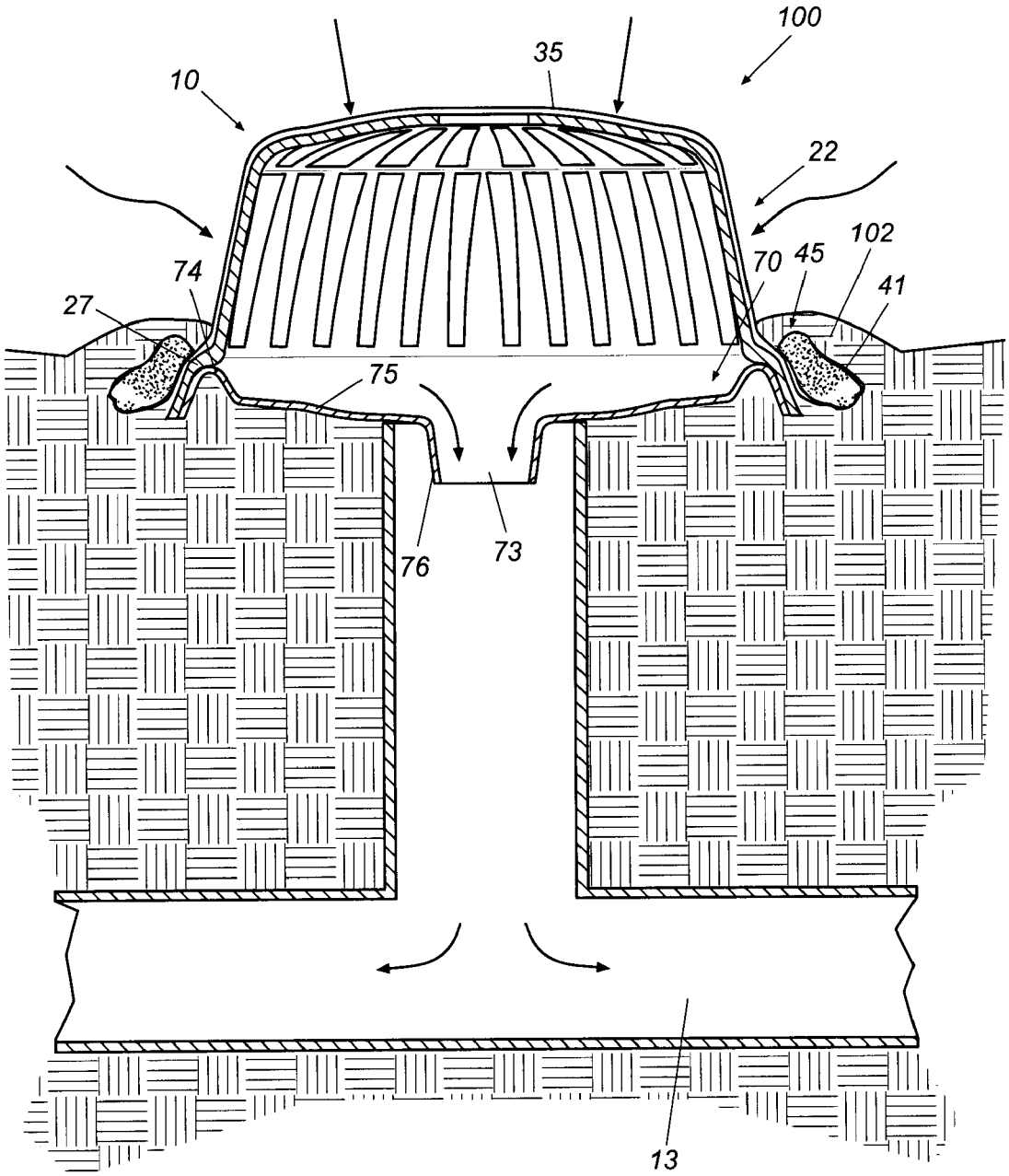
FIG. 12 is a cross-sectional side view of the silt guard coupled to the fluid distributing pan, the fluid distributing pan fitting over, seating upon and being removably mountable to the drainage pipe according to one aspect of the present invention.

As stated above, the silt guard or filtering device 10 is coupled to the fluid distributing pan 70. As shown in FIG. 12, the bottom rim 27 of the silt guard 10 can be sloped to receive a connecting member 74 that bas been formed in the shape of a raised collar. Alternatively, the connecting member 74 can include other structure designed to couple the silt guard to the fluid distributing pan.

Figure 13A:
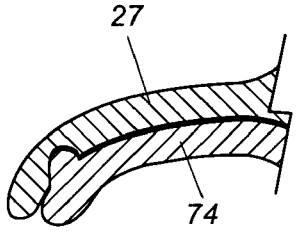
FIGS. 13*a–d* illustrate various embodiments of means to engage to fasten or couple the silt guard to the fluid distributing pan.
Figure 13B:
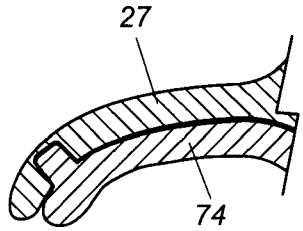
Figure 13C:
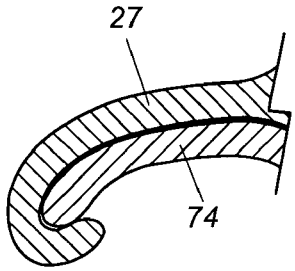
Figure 13D:
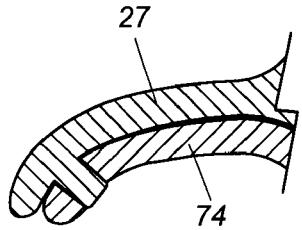

Turning to FIGS. 13*a*–*d*, the bottom rim 27 of the silt guard or filtering device generally will be shaped to receive or be received by the connecting member 74 of the fluid distributing pan for attachment thereto in a substantially tight, snug fit. As shown herein, bottom rim 27 may include/be formed with a protrusion (FIG. 13*d*), or with a C-shaped lip (FIG. 13*c*) to facilitate, for instance, snapping the silt guard into engagement with the connecting member 74 of the fluid distributing pan. Likewise, the bottom rim 27 and connecting member 74 may also be formed with a clip, hook or other, similar snap-in or snap-on device, as shown in FIGS. 13*b*, 13*c* and 13*d*, and/or can include other types of connectors or fasteners, such as a bolt, nail, rivet, screw, or latch to couple the silt guard 10 to the fluid distributing pan 70. Likewise, bottom rim 27 may be formed with a circumferential groove into which a raised ridge on the surface of connecting member 74 can be squeezed or snapped (FIG. 13*a*). Depending on the intended use, it may be sufficient to couple the silt guard and the fluid distributing pan together using merely a snug fitting engagement, whereas in other applications, it may be more appropriate to secure these together in a locking engagement or arrangement.

In use as indicated in FIG. 12, the outlet tube 76 will be connected to and/or disposed within the drainage pipe 13, thereby interconnecting the drainage pipe 13 to the silt guard apparatus 100. When the fluid distributing pan 70 only contains a fluid distributing orifice 73, the orifice 73 will be in fluid communication with the drainage pipe 13. Additionally, and as shown in FIG. 8, a reducer 79 maybe used to assist in interconnecting the fluid distributing pan 70 to the drainage pipe 13, as long as the reducer 79 does not adversely impact the venturi effect (that will be discussed in more detail below).

The fluid distributing orifice 73 typically will further have a dimension sized smaller than an inside dimension of the drainage pipe 13. In this way, the flow of the water is restricted as it flows into the drainage pipe. This enables the flow of water out of the detention pond to be controlled, thereby allowing more residence time for the silt guard apparatus to filter the solid particles from the water. Additionally, the flow of water from storm water runoff can be decreased to limit a flooding effect. Further, by directing the water to flow through the silt guard apparatus, the restriction created by the smaller diameter of the orifice than the diameter of the drainage pipe will typically form a venturi effect (a suction) between the fluid distributing pan and the drainage pipe, causing the fluid distributing pan to substantially seal against the drainage pipe. When this occurs, the water is substantially blocked from seeping under the edges of the fluid distributing pan, and instead will be directed into the silt guard or filtering device, thereby affording an opportunity for filtering to occur. Additionally, as the water passes over the fluid distributing pan, additional forces are created in a downward motion, which is additive to the venturi effect and assists in the stabilization of the silt guard apparatus in place and seated upon or interconnected with the drainage pipe. Another feature of the silt guard apparatus 100 of the present invention is that it is uniquely capable of being submersed below the water level of the detention pond. Under such circumstances, when the apparatus is submersed, the weight of the water will additionally assist in stabilizing the apparatus to the drainage pipe to keep it from becoming dislodged.

To facilitate movement of water towards the fluid distributing orifice 73, the fluid receiving body 75 of the fluid distributing pan 70 will preferably slope from the connecting member 74 toward the fluid distributing orifice 73. Additionally, the fluid receiving body 75 typically is formed of a rigid, durable material that has a substantially smooth surface so that any solid particle(s) 102 that manage to pass through the porous filter material 42 will not collect on the fluid distributing pan. Moreover, the fluid distributing pan 70 and the silt guard 10 are typically constructed from a rigid, durable plastic material such as polyvinylchloride (PVC), acyrilonitrile-butadiene-styrene (ABS), polyethylene, polyurethane, acetal resin such as DELRIN®, nylon or any other similar rigid, durable, high strength materials, including metals such as aluminum, copper, stainless steel, concrete, fiberglass, and the like, including combinations of any of the above. Preferably, such materials will be relatively lightweight for ease of handling. As used herein, the term "lightweight" means that the item is capable of being handled, lifted or manipulated by one person. In a preferred embodiment, the silt guard apparatus of the present invention will be lightweight.

Accordingly, it can be seen that the present invention provides a unique silt guard apparatus for fitting over and seating upon the drainage pipe and forcing the water to pass through the silt guard apparatus, thereby filtering solid particles and/or oily residues. The apparatus can withstand the substantial weight and the accompanying force of dirt and debris urged or collected thereagainst to prevent this dirt and debris from collecting within the drainage pipe or drop inlet, as well as restrict unauthorized or accidental access to the open upper end of the drainage pipe or drop inlet while still enabling storm runoff water to be drained from the site without clogging the drainage system or adjacent streams or lots with eroded soil and construction debris. Further, the removal of oily residues serves an equally important ecological role. In addition, when present, the lightweight construction and design of the silt guard apparatus of the present invention enables ease of handling, lifting or manipulation by one person.

Figure 14:
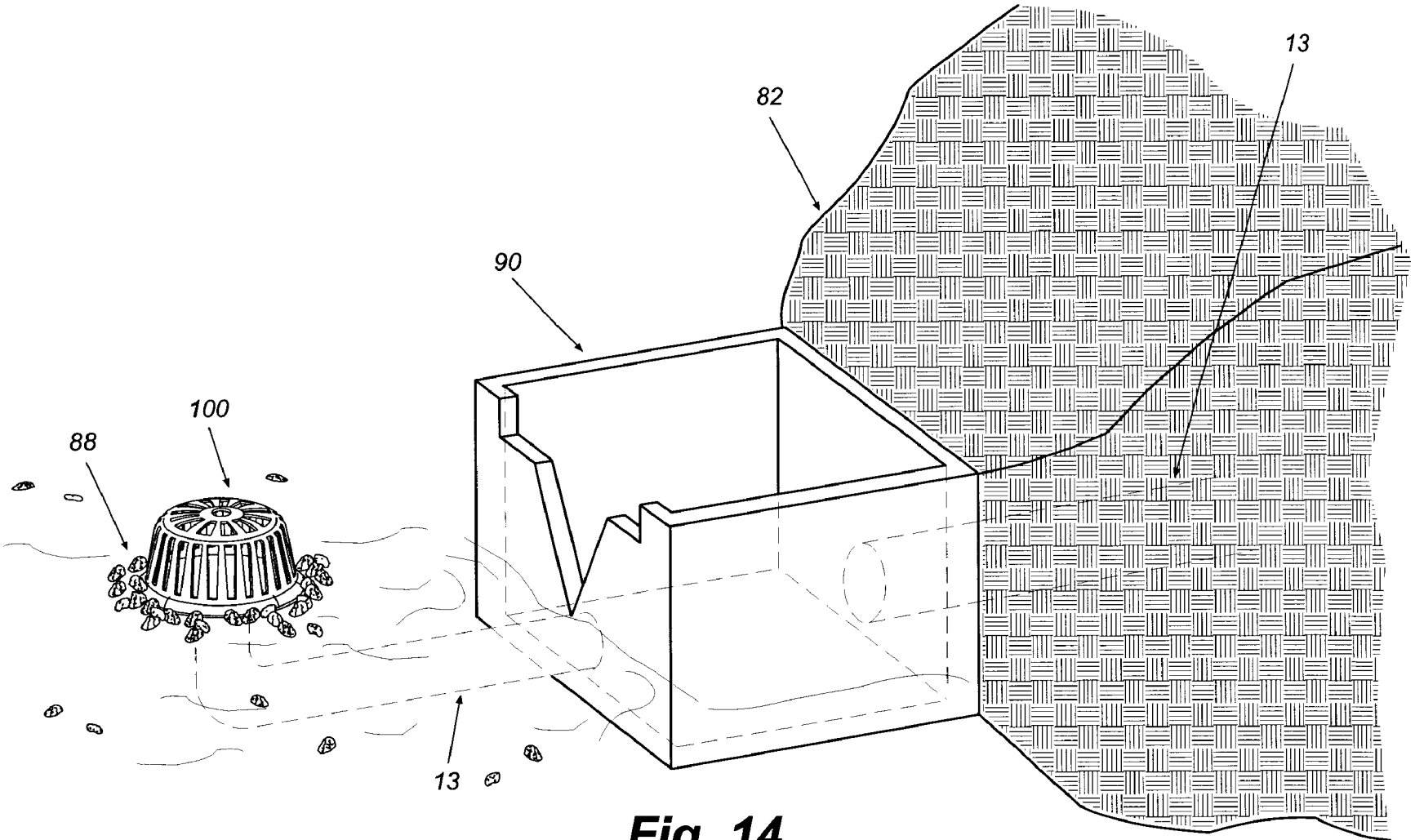
FIG. 14 is a top perspective view of a sediment retention structure according to the present invention attached in-line with a V-shaped weir of the prior art.

As further contemplated by the present invention, FIG. 14 illustrates a silt guard apparatus or sediment retention structure 100 according to the present invention, wherein the silt guard apparatus is attached in-line with a V-shaped weir 90 of the prior art. As represented here, the V-shaped weir 90 backs up to an earthen berm 82 and is typically used to provide a means for holding the water outside of the weir long enough for the silt and solid particles to settle out of the water. The clean water then flows over into the inside of the weir and subsequently into the drainage pipe 13. In this embodiment, the silt guard apparatus 100 is attached to the V-shaped weir 90 using a drainage pipe 13 such that any water passing through the silt guard apparatus 100 will be filtered prior to reaching the inside of the V-shaped weir 90. Further as shown herein, graded stone 88, usually having a diameter of 3 to 4 inches, provides a means to hold the silt guard apparatus 100 in place.

Figure 15:
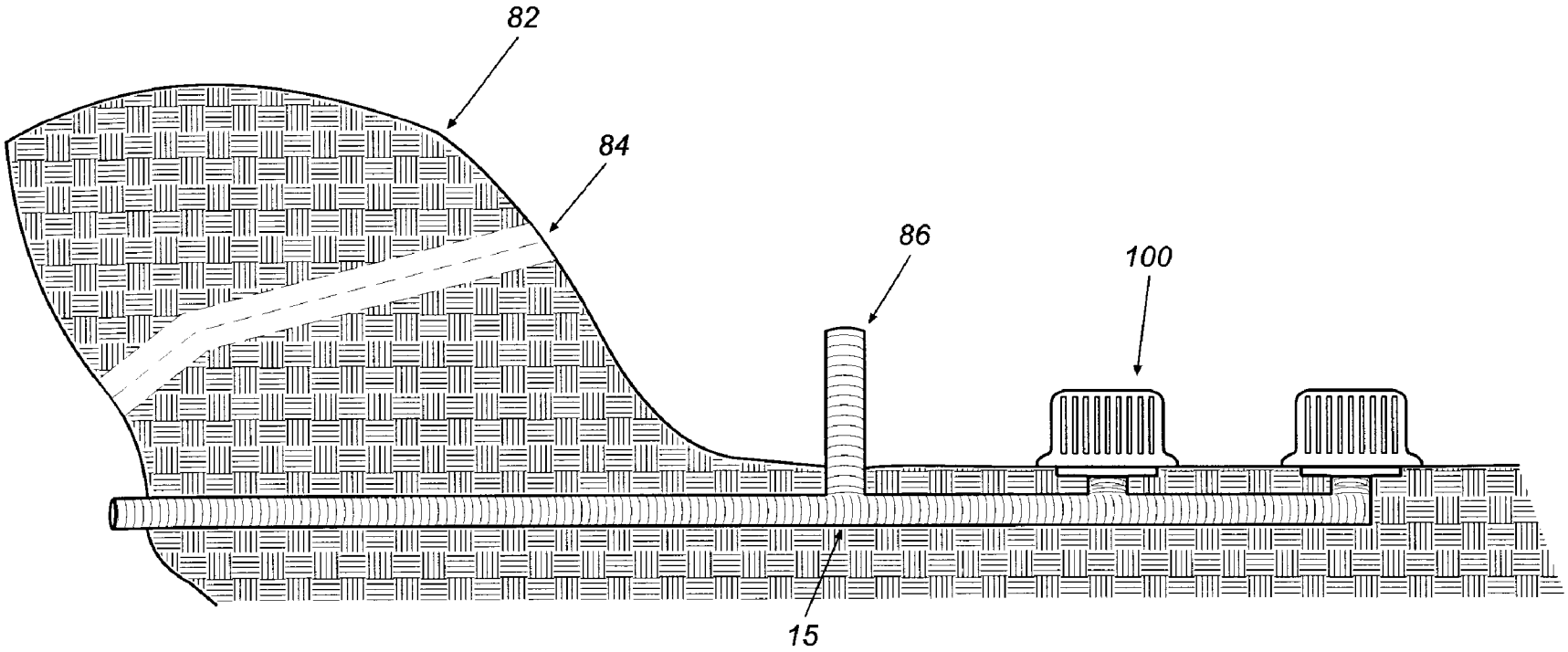
FIG. 15 is a side elevational view of a sediment retention structure according to the present invention, wherein two such structures are connected in-line to improve efficiency of sediment reduction.

As yet another alternative use of the present invention, FIG. 15 illustrates the use of multiple silt guard apparatus 100 to facilitate reduction of soil and erosion control. As shown herein, an earthen berm 82 has been created to create the water collection area, this time utilizing a spillway 84, (in this case a concrete spillway,) and a standpipe 86 is provided to prevent flooding and to control extremely heavy rainflow situations. Typically, two such structures 100 are connected in-line to a flexible down drain pipe 15 to improve efficiency of the sediment reduction.

As described in detail above, Federal, State and Local regulations prescribe the steps an operator must take to prevent soil erosion. Also contemplated by the present invention is a method for establishing a system to implement an erosion and sedimentation control program for a construction site. One step in establishing the system is to plan the control program suitable to a natural topography and soil condition of the site to be cleared. Since the erosion process is influenced by climate, topography, soils and vegetative cover, all of these must be carefully evaluated prior to preparing the control program. As for topography, the size, shape and slope characteristics of a watershed influence the amount and duration of runoff. The greater the slope length and gradient, the greater the potential for both runoff and erosion. Velocities of water will increase as the distance from the top of the slope or the grade of the slope increase. Likewise, soil type must be considered for its vulnerability to erosion. Properties determining the erodibility of a soil are texture, structure, organic matter content and permeability. Soil containing high percentages of fine sands and silt are normally the most erodible. As the clay and organic matter content of these soils increases, the erodibility decreases. Clays act as a binder to soil particles thus reducing erodibility. But, while clays have a tendency to resist erosion, they are easily transported by water once eroded. Soils high in organic matter resist rain drop impact and the organic matter also increases the binding characteristics of the soil. Clearly, well-graded and well-drained gravels are usually the least erodible soils. The high infiltration rates and permeabilities either prevent or delay runoff.

Another consideration in preparing the construction site is the need to minimize disturbance to the natural vegetation. Vegetative cover is an extremely important factor in reducing erosion form a site. It has the potential to prevent erosion by absorbing energy of rain drops, binding soil particles, slowing velocity of runoff water, increasing the ability of a soil to absorb water, and removing subsurface water between rainfalls through the process of evapotranspiration. By limiting the amount of vegetation disturbed and the exposure of soils to erosive elements, soil erosion can be greatly reduced. The silt guard apparatus or sediment retention structure of the present invention further can be employed to provide the erosion and sedimentation control and also thereby clean the storm water runoff.

In some locales, it may be required to further collect the storm water runoff and then analyze it for such properties as turbidity. Turbidity is a unit of measurement quantifying the degree to which light traveling through a water column is scattered by the suspended organic (including algae) and inorganic particles. The scattering of light increases with a greater suspended load. Turbidity is commonly measured in Nephelometric Turbidity Units (NTU), but may also be measured in Jackson Turbidity Units (JTU). Land-derived sand, silt, clay, and organic particles dislodged by rainfall and carried by overland flow may cloud surface water systems. Particulate matter may be resuspended from the bottom sediments by changes in the speed or direction of the water current. When incorporating the apparatus and/or method of the present invention, the turbidity may be reduced by at least about 20% from a turbidity of the storm water runoff prior to passing through the apparatus.

Further contemplated by the present invention is the possibility of using the apparatus and/or method of the present invention for filtering concrete from a water stream and filtering oily residue from storm water runoff. For instance, after a mixer or other concrete conveying device has been utilized to distribute the fluidized concrete where needed, these devices are usually washed down with a water stream to remove as much of the remaining concrete of the present invention. In the case where such wash down occurs in a water collection area, an apparatus of the present invention may be installed to filter the concrete from the water stream.

Likewise, the apparatus of the present invention may be used to filter oily residues from storm water runoff. A typical scenario would be a large parking lot where cars, trucks, buses and the like, are allowed to leak oils and grease on to the surface of the parking lot. When a rain storm washes these from the surface, the oily residues will be carried with the water into the storm water drainage system. Utilizing the apparatus of the present invention to intercept this dirty storm water runoff and filter it prior to reaching the drainage system provides an important environmental control.

The present invention includes a method for implementing an erosion and sedimentation control program for a construction site comprising: developing an erosion control program suitable to a natural topography and soil conditions of the site to be cleared; providing stabilization of disturbed areas; providing drainage to convey storm water runoff from the site; retaining sediment by providing a sediment retention structure, the sediment retention structure further comprising: a fluid distributing pan having a fluid distributing orifice in fluid communication with a drainage pipe, wherein the fluid distributing pan fits over and seats upon the drainage pipe; a silt guard coupled to the fluid distributing pan opposite the drainage pipe, wherein the silt guard has a body portion, a top portion and a filter, the body portion being in fluid communication with the orifice and having an open lower end attached to the fluid distributing pan, a spaced upper end, and a series of ribs extending between the upper and lower ends and defining passages there between in fluid communication with the fluid distributing orifice and with the filter received over the body portion and being formed from a porous filtering material; and directing the storm water runoff with sediment substantially clean therefrom through the fluid distributing orifice and the drainage pipe.

The method may also include: collecting the storm water runoff; and analyzing the collected storm water runoff for turbidity such that the turbidity is reduced by at least about 20% from a turbidity of the storm water runoff prior to passing through the sediment retention structure.

The present invention also includes a method for filtering concrete from a water stream comprising: providing a water collection area to collect concrete as the concrete is being washed down with the water stream from a concrete conveying device; passing the concrete laden water stream through a concrete retention structure, the concrete retention structure comprising: a silt-guard coupled to a drainage system for conveying the water stream, wherein the silt guard has a body portion, and a filter; the body portion having an open end attached to and in fluid communication with the drainage system and further having a series of ribs extending between the upper and lower ends of the body and defining passages there between in fluid communication with the drainage system; and with the filter received over and supported on the body portion, the filter being formed from a porous filtering material; retaining and filtering the concrete from the water stream as it passes through the concrete retention structure; and directing the filtered water stream into the drainage system.

The method may also include: providing a drainage pipe to the measures to convey the concrete and the water stream; and providing a fluid distributing pan having a fluid distributing orifice, the orifice being in fluid communication with the drainage pipe, wherein the fluid distributing pan fits over and seats upon the drainage pipe and the fluid distributing pan being removably mountable to the drainage pipe; the fluid distributing pan fitting over and seating upon the drainage pipe on one side and a silt guard coupling to the fluid distributing pan opposite the drainage pipe.

It will be understood by those skilled in the art that while the present invention has been described in terms of a preferred embodiment thereof, numerous modifications, additions and changes can be made thereto without departing from the spirit and scope of the invention as set forth in the following claims.

What is claimed is:

1. A silt guard apparatus for filtering solid particles and/or oily residues from a flow of water into a drainage pipe, the apparatus comprising:

a fluid distributing pan having a fluid distributing orifice, the orifice being in fluid communication with the drainage pipe, wherein the fluid distributing pan fits over and seats upon the drainage pipe and the fluid distributing pan being removably mountable to the drainage pipe;

a silt guard coupled to the fluid distributing pan opposite the drainage pipe, wherein the silt guard has a body portion, a top portion and a filter;

the body portion being in fluid communication with the orifice and the body portion having an open lower end attached to the fluid distributing pan, a spaced upper end, and a series of ribs extending between the upper and lower ends and defining passages therebetween in fluid communication with the fluid distributing orifice;

the top portion extending upwardly from the body portion; and the filter received over and supported by the top portion and overlapping the body portion for filtering solid particles and/or oily residues from the water passing therethrough and into the drainage pipe, the filter being formed from a porous filtering material.

2. The silt guard apparatus of claim 1 and wherein the fluid distributing pan further comprises a fluid receiving body surrounding the orifice, and a connecting member contiguous with the fluid receiving body, and wherein the orifice comprises a dimension sized smaller than an inside dimension of the drainage pipe.

3. The silt guard apparatus of claim 1 and wherein the filter is formed from a nonwoven material.

4. The silt guard apparatus of claim 2 wherein the fluid receiving body of the fluid distributing pan has a sloping surface extending from the connecting member towards the fluid distributing orifice.

5. The silt guard apparatus of claim 2 wherein the connecting member of the fluid distributing pan engages to fasten the fluid distributing pan to the silt guard.

6. The silt guard apparatus of claim 2 wherein the connecting member of the fluid distributing pan further comprises at least one of a raised collar, snap-in device, snap-on device, bolt, nail, rivet, screw, or latch to couple the silt guard to the fluid distributing pan.

7. The silt guard apparatus of claim 1 wherein the fluid distributing pan interconnects and substantially seals the silt guard to the drainage pipe.

8. The silt guard apparatus of claim 1 wherein the combination of the fluid distributing pan and the silt guard is lightweight.

9. The silt guard apparatus of claim 1 wherein the fluid distributing pan and the silt guard are formed of a rigid, durable material.

10. The silt guard apparatus of claim 1 and further comprising an outlet tube extending from the body portion to form the fluid distributing orifice, the outlet tube being disposed within the drainage pipe, the outlet tube having a diameter smaller than a diameter of the drainage pipe.

11. The silt guard apparatus of claim 10 and wherein a resulting venturi effect is created by a difference in diameters of the fluid distributing orifice and the drainage pipe so as to interconnect and substantially seal the silt guard against the drainage pipe upon a downward flow of water through the silt guard and the fluid distributing pan.

12. The silt guard apparatus of claim 1 wherein the fluid distributing pan has a shape comprising rectangular, square, or substantially circular-shaped.

13. The silt guard apparatus of claim 1 and further comprising a support ring formed about the filter, the support ring receiving a filler material to ensure the filter is maintained on the body portion.

14. A method for filtering oily residue from storm water runoff comprising:

providing a drainage system to convey storm water runoff, the system further comprising a drainage pipe;

retaining the oily residue by providing a residue retention structure, the residue retention structure further comprising: a fluid distributing pan having a fluid distributing orifice, the orifice being in fluid communication with the drainage pipe, wherein the fluid distributing pan fits over and seats upon the drainage pipe and the fluid distributing pan being removably mountable to the drainage pipe; a silt guard coupled to the fluid distributing pan opposite the drainage pipe, wherein the silt guard has a body portion, a top portion and a filter; the body portion being in fluid communication with the orifice and the body portion having an open lower end attached to the fluid distributing pan, a spaced upper end, and a series of ribs extending between the upper and lower ends and defining passages therebetween in fluid communication with the fluid distributing orifice; the top portion extending upwardly from the body portion; and the filter received over and supported by the top portion and overlapping the body portion, the filter being formed from a porous filtering material and thereby filtering the residue from the storm water runoff.

15. A fluid distributing pan for interconnecting and substantially sealing a silt guard to a drainage pipe comprising:

a fluid distributing orifice having a dimension sized smaller than an inside dimension of the drainage pipe;

a fluid receiving body surrounding the orifice; and a connecting member contiguous with the fluid receiving body, the fluid receiving body interposing the connecting member and the orifice, wherein the connecting member couples the silt guard to the fluid distributing pan, and wherein the fluid distributing pan serves to substantially seal the silt guard against the drainage pipe.

16. The fluid distributing pan of claim 15 and wherein the connecting member engages a lower rim of the silt guard to fasten the fluid distributing pan to the silt guard.

17. The fluid distributing pan of claim 15 and wherein the fluid distributing pan is formed of a rigid, durable material.

18. The fluid distributing pan of claim 15 wherein the connecting member further comprises at least one of a raised collar, snap-in device, snap-on device, bolt, nail, rivet, screw, or latch to couple the silt guard to the fluid distributing pan.

19. The fluid distributing pan of claim 15 wherein the fluid receiving body of the fluid distributing pan slopes from the connecting member toward the fluid distributing orifice.

20. The fluid distributing pan of claim 19 and further comprising an outlet tube extending from the fluid receiving body to form the fluid distributing orifice and the outlet tube being disposed within the drainage pipe, the outlet tube having a diameter smaller than a diameter of the drainage pipe, and further wherein a resulting venturi effect created by the difference in diameters of the fluid distributing orifice and the drainage pipe substantially seals the silt guard against the drainage pipe upon downward flow of water through the silt guard and the fluid distributing pan.

21. The fluid distributing pan of claim 15 wherein the fluid distributing pan is rectangular, square, or substantially circular shaped.

22. A submersible silt guard apparatus for filtering oily residue and solid particles from a drainage system, the drainage system having a drainage pipe, the apparatus comprising:

a substantially ring-shaped fluid distributing pan having a fluid receiving body, an outlet tube extending from the fluid receiving body to form a fluid distributing orifice, wherein the outlet tube is in communication with the drainage pipe, and a raised collar contiguous with the fluid receiving body;

a silt guard having an elongate tubular member, the elongate tubular member formed about a longitudinal axis, the tubular member having a first end, a spaced second end, and a bottom rim coupled to the fluid distributing pan opposite the drainage pipe, the tubular member further having a series of radially spaced openings defined in the tubular member intermediate the first end and the second end; and a filter formed from a nonwoven filtering material and sized and shaped to fit over the tubular member covering the radially spaced series of openings defined in the tubular member, for filtering solid particles from a flow of water passing therethrough and draining into the drainage pipe.

23. The silt guard apparatus of claim 22 and wherein the outlet tube has an outer diameter sized smaller than an inside diameter of the drainage pipe.

24. A method for implementing an erosion and sedimentation control program for a construction site comprising:

developing an erosion control program suitable to a natural topography and soil conditions of the site to be cleared;

providing stabilization of disturbed areas;

providing drainage to convey storm water runoff from the site;

retaining sediment by providing a sediment retention structure, the sediment retention structure further comprising:

a fluid distributing pan having a fluid distributing orifice in fluid communication with a drainage pipe, wherein the fluid distributing pan fits over and seats upon the drainage pipe;

a silt guard coupled to the fluid distributing pan opposite the drainage pipe, wherein the silt guard has a body portion, a top portion and a filter, the body portion being in fluid communication with the orifice and having an open lower end attached to the fluid distributing pan, a spaced upper end, and a series of ribs extending between the upper and lower ends and defining passages therebetween in fluid communication with the fluid distributing orifice and with the filter received over the body portion and being formed from a porous filtering material; and directing the storm water runoff with sediment substantially cleaned therefrom through the fluid distributing orifice and the drainage pipe.

25. The method of claim 24 further comprising:

collecting the storm water runoff; and analyzing the collected storm water runoff for turbidity such that the turbidity is reduced by at least about 20% from a turbidity of the storm water runoff prior to passing through the sediment retention structure.

26. A method for filtering concrete from a water stream comprising:

providing a water collection area to collect concrete as the concrete is being washed down with the water stream from a concrete conveying device;

passing the concrete laden water stream through a concrete retention structure, the concrete retention structure comprising:

a silt guard coupled to a drainage system for conveying the water stream, wherein the silt guard has a body portion, and a filter; the body portion having an open lower end attached to and in fluid communication with the drainage system and further having a series of ribs extending between the upper and lower ends of the body and defining passages therebetween in fluid communication with the drainage system; and with the filter received over and supported on the body portion, the filter being formed from a porous filtering material;

retaining and filtering the concrete from the water stream as it passes through the concrete retention structure; and directing the filtered water stream into the drainage system.

27. The method of claim 26 further comprising:

providing a drainage pipe to the measures to convey the concrete and the water stream; and providing a fluid distributing pan having a fluid distributing orifice, the orifice being in fluid communication with the drainage pipe, wherein the fluid distributing pan fits over and seats upon the drainage pipe and the fluid distributing pan being removably mountable to the drainage pipe; the fluid distributing pan fitting over and seating upon the drainage pipe on one side and the silt guard coupling to the fluid distributing pan opposite the drainage pipe.

* * * * *